US012674359B1

(12) United States Patent
Zhang

(10) Patent No.: US 12,674,359 B1
(45) Date of Patent: Jul. 7, 2026

(54) UPDATED STEERING PAD CONTROL DEVICE

(71) Applicant: Halliburton Energy Services, Inc., Houston, TX (US)

(72) Inventor: Lizheng Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/269,474

(22) Filed: Jul. 15, 2025

(51) Int. Cl.
*E21B 7/06* (2006.01)
*E21B 21/10* (2006.01)

(52) U.S. Cl.
CPC ..... *E21B 7/06* (2013.01); *E21B 21/10* (2013.01)

(58) Field of Classification Search
CPC ..... E21B 21/10; E21B 7/06
See application file for complete search history.

(56) References Cited

U.S. PATENT DOCUMENTS 5,787,052 A * 7/1998 Gardner ..... E21B 47/18 367/148
10,331,433 B2 6/2019 Shimotani
10,577,927 B2 * 3/2020 Odegbami ..... E21B 47/20
2002/0179336 A1 12/2002 Schaaf et al.
2007/0221409 A1 * 9/2007 Hall ..... E21B 4/14 175/73
2012/0061148 A1 3/2012 Clausen et al.
2012/0160565 A1 6/2012 Downton et al.
2024/0044209 A1 * 2/2024 Zhang ..... E21B 7/06

FOREIGN PATENT DOCUMENTS

WO 2019133033 A1 7/2019

OTHER PUBLICATIONS

Foreign Communication from Related Application—International Search Report and Written Opinion of the International Searching Authority, International Application No. PCT/US2025/041632, dated Apr. 14, 2026, 9 pages.

* cited by examiner

*Primary Examiner* — Theodore N Yao
(74) *Attorney, Agent, or Firm* — Conley Rose, P.C.; Rodney B. Carroll

(57) ABSTRACT

A rotary steerable drilling system can be positioned in a subterranean formation to steer a drill to form a wellbore in the subterranean formation. An orientation of a steering valve, which is positioned in the rotary steerable drilling system, can be adjusted to cover each channel of one or more channels of a valve seat adjacent the steering valve to deactivate each steering pad of one or more steering pads of the rotary steerable drilling system. The orientation of the steering valve can be adjusted to activate at least one steering pad of the one or more steering pads of the rotary steerable drilling system. Pressure relief, for example when all steering pads are deactivated, can be provided by a blind notch recess in the steering valve overlapping with a notch extending radially from a central channel of the valve seat.

20 Claims, 15 Drawing Sheets

UPDATED STEERING PAD CONTROL DEVICE

CROSS-REFERENCE TO RELATED APPLICATIONS

None.

STATEMENT REGARDING FEDERALLY SPONSORED RESEARCH OR DEVELOPMENT

Not applicable.

FIELD

The present disclosure relates generally to wellbore operations and, more particularly (although not necessarily exclusively), to a steering valve for controlling (e.g. deactivating) a steering pad of a rotary steerable system. Still more particularly, this disclosure relates to such steering valves configured for pressure relief.

BACKGROUND

A wellbore can be formed in a subterranean formation for extracting produced hydrocarbon material or other suitable material. The wellbore may experience or otherwise encounter one or more wellbore operations such as drilling the wellbore. Drilling, or otherwise forming, the wellbore can involve using a drilling system that can include a drill bit and other suitable tools or components for forming the wellbore. During drilling, the drilling system can use a steering pad to change the course of the drill bit by applying pressure to a wall of the wellbore. Deactivating the steering pad can be difficult. Accordingly, improvements to such steering systems are desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
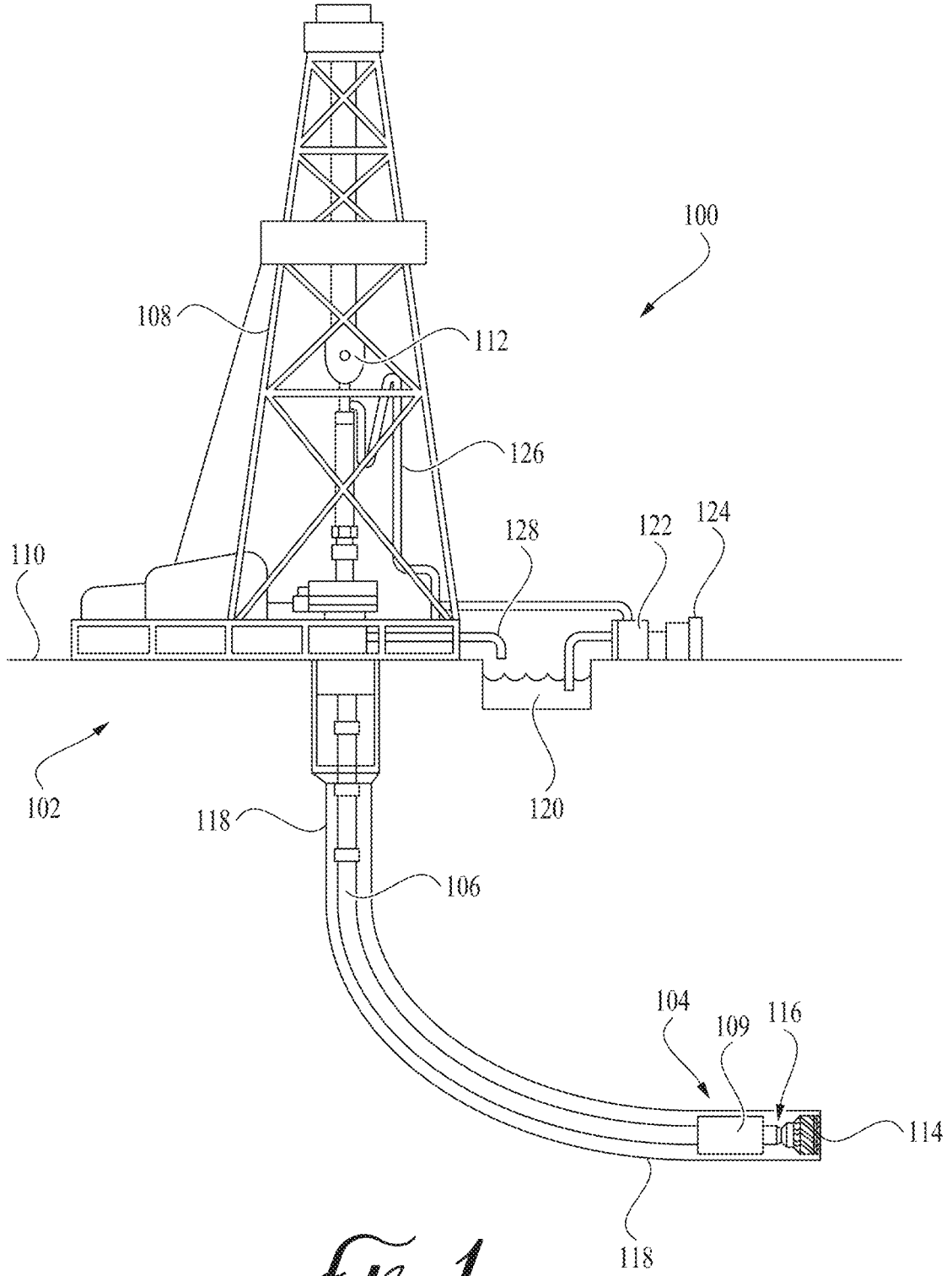
FIG. 1 is a schematic of a well system that can use a rotary steerable system with a steering valve to form a wellbore according to one example of the present disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Certain aspects and examples of the present disclosure relate to a steering valve that can be used to deactivate a rotary steerable system of a wellbore. The rotary steerable system can be positioned in a wellbore for drilling or otherwise forming a wellbore that may not be linear. For example, the rotary steerable system can include or otherwise be coupled to a drill bit that can be steered to cause a wellbore to be formed. Deactivating the rotary steerable system may involve preventing steering pads of the rotary steerable system from actuating (e.g., outward) and/or retracting steering pads that were previously extended. When actuated, the steering pads may apply a force to a wall of the wellbore to cause the drill bit to change direction. The steering valve can control which steering pads of the rotary steerable system to actuate. For example, the steering valve can be positioned in the rotary steerable system to allow fluid to flow to one or more steering pads, to prevent fluid from flowing to the steering pads, etc. Fluid flowing to a steering pad may cause the steering pad to actuate. The steering valve can include a cut-off portion that can be used to prevent fluid from flowing to each of the steering pads included in the rotary steerable system for deactivating the rotary steerable system. For example, the cut-off portion can be positioned adjacent to a channel of a valve seat adjacent to the steering valve such that the cut-off portion blocks fluid from flowing to a particular steering pad, while a closed portion of the steering valve can be positioned adjacent to remaining channels of the valve seat for blocking fluid from flowing to the remaining steering pads.

Allowing at least one of the steering pads to actuate when fluid flows through a bottom-hole assembly of the wellbore can result in excessive wear on components included in the rotary steerable systems. For example, a steering pad can experience excessive wear, the wellbore can be damaged, and the like. In some examples, steering pads can be mechanically coupled to the rotary steerable systems via a joint that allows the steering pads to rotate with respect to the rotary steerable systems. If the steering pads actuate prematurely, the joint may be subject to unnecessary torque that may not contribute to any steering or adjustment of trajectory associated with the rotary steerable system. The unnecessary torque can degrade the hinge and compromise the structural integrity of some parts of the rotary steerable system. Furthermore, allowing the steering pads to actuate prematurely can result in undesired friction, which can result in excessive wear, between a casing sleeve of a wellbore and the steering pads. Excessive wear on the steering pad can compromise the ability of the steering pad to steer the rotary steerable system.

The steering valve can address the above challenges by causing the steering pads of the rotary steerable system to deactivate. For example, the steering valve can cause the steering pads of the rotary steerable system to be constrained or to be deactivated at an onset of a drilling operation to form the wellbore. In some examples, the steering valve can be used to deactivate the steering pads when passing through a multi-lateral wellbore side-track exit window or in other suitable scenarios. Additionally, the steering valve can be used to deactivate the steering pads or to cut off high-pressure flow to one or more components (e.g., pistons) of the rotary steerable system when not steering to reduce wear or damage to the corresponding components. For example, the steering valve can be used to deactivate the steering pads to reduce wear or damage (thereby extending the useful life thereof) to (i) an elastomer seal of the rotary steerable system, (ii) a metal-to-metal seal of the rotary steerable system, (iii) one or more steering pads, (iv) one or more lateral steering pads or steering pad interfaces, (v) the steering valve, and other suitable components of the rotary steerable system. Additionally, the steering valve can be used to deactivate the steering pads when not steering to reduce noise detected by a mud telemetry system of the wellbore.

The steering valve can include a cut-off portion included in an open portion of the steering valve. For example, a closed portion of the steering valve can include an angle of approximately 240°, and an open portion of the steering valve can include an angle of approximately 120°, though any other suitable angles can be used for the closed position and for the open position of the steering valve. The open portion and the closed portion may be adjacent one another, and the open portion can allow fluid to flow through the rotary steerable system for activating at least one steering pad, while the closed portion can prevent fluid from flowing through the rotary steerable system and may prevent at least one steering pad from actuating.

The cut-off portion can be positioned in the open portion of the steering valve. For example, the cut-off portion may be centrally positioned within the open portion such that the cut-off portion can, at least momentarily during operation of the steering valve, block fluid from flowing through the rotary steerable system, which may prevent the steering pads of the rotary steerable system from actuating. The cut-off portion, for example alternatively to being centrally positioned, may be positioned offset within the open portion of the steering valve. Additionally, an average steering force of the rotary steerable system using the steering valve may not involve a measurable reduction compared to an average steering force of other rotary steerable systems using other steering valves that do not include the cut-off portion. Accordingly, by using the steering valve, a performance of the rotary steerable system can be maintained, while extending the useful life of components of the rotary steerable system and reducing a risk of damaging the wellbore.

In some examples, the steering valve can be used with an existing valve seat of the rotary steerable system. For example, the existing valve seat can include four openings (e.g., channels): (i) three similarly sized and shaped openings corresponding to the steering pads and arranged equidistant from one another on a common radius from a center of the valve seat and (ii) a central opening that allows fluid to return from the rotary steerable system. Other suitable configurations for the valve seat are possible, including configurations in which the openings corresponding to the steering pads are not equidistant, are not on a common radius, and the like. Additionally, the valve seat may include other suitable numbers (e.g., less than four or more than four) openings. The steering valve can be positioned on (e.g., abutting or otherwise adjacent) a face of the valve seat, and the steering valve can be rotated for selecting one or more, or zero, steering pad openings of the valve seat through which to allow fluid flow to activate the corresponding steering pad. In some examples, the steering valve can be positioned with respect to the valve seat such that each of the steering pad openings are blocked. For example, the closed portion of the steering valve can be positioned to block fluid from flowing through a first steering pad opening and a second steering pad opening, while the cut-off portion can be positioned to block fluid from flowing through a third steering pad opening. In such examples, the steering pads of the rotary steerable system may be deactivated or may otherwise not actuate.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can use a rotary steerable system 109 with a steering valve to steer a drill in a wellbore 118 according to one example of the present disclosure. The well system 100 can include the wellbore 118 that can be used to extract hydrocarbons from a subterranean formation 102, though the wellbore 118 may alternatively be positioned in a sub-oceanic formation or any other suitable location. The wellbore 118 can be drilled or otherwise formed using the well system 100. For example, the well system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 that can be used to lower and raise the drill-string 106.

The BHA 104 may include a drill bit 114, a rotary steerable system 109, other suitable components, or any suitable combination thereof. The drill bit 114 can be operatively coupled to a tool string 116, and the drill bit 114 may be moved axially within a drilled wellbore 118 and can be attached to the drill-string 106. During operation, the drill bit 114 can penetrate the subterranean formation 102 to create the wellbore 118. The BHA 104 can control the drill bit 114 as the drill bit 114 advances into the subterranean formation 102. For example, the rotary steerable system 109 can control a direction of drilling by applying a steering pressure or other suitable force to a wall of the wellbore 118. The steering pressure, for example an amount of pressure, a direction of pressure, or the like, can be controlled with a steering valve included in the rotary steerable system 109.

Fluid or "mud" from a mud tank 120 may be pumped downhole using a mud pump 122 that can be powered by an adjacent power source, such as a prime mover or motor 124. The mud may be pumped from the mud tank 120, through a stand pipe 126, which can feed the mud into the drill-string 106, the rotary steerable system 109, or other suitable components of the well system 100 and can convey the mud to the drill bit 114. The mud can exit one or more nozzles (not shown) arranged in the drill bit 114 and can thereby cool the drill bit 114. Additionally or alternatively, the mud can be directed (e.g., as pressurized mud) into the rotary steerable system 109 for adjusting a direction of the drill bit 114. In some examples, the steering valve can control, for example an amount, a direction, or the like, the mud being directed into the rotary steerable system 109. After exiting the drill bit 114 or other suitable component, the mud can circulate back to the surface 110 via the annulus defined between the wellbore 118 and the drill-string 106. Cuttings and mud mixture that can be passed through a flow line 128 can be processed such that a cleaned mud is returned down hole through the stand pipe 126.

The rotary steerable system 109 can include a steering collar, an actuation cylinder, a seal, the steering valve, and any other suitable components. The steering collar can provide a rigid frame for the rotary steerable system 109, and the actuation cylinder can include a piston that can be used to apply the steering pressure or other suitable forces for causing steering pads of the rotary steerable system 109 to actuate outwards. The seal can be positioned between the steering collar and the actuation cylinder for forming a pressure seal or other suitable type of seal in the rotary steerable system 109. For example, the seal can allow the rotary steerable system 109 to receive pressure (e.g., via pressurized mud, etc.) that can be used to apply the steering force. The steering valve can be used to control the received pressure to cause the steering pads to actuate. For example, the steering valve can be positioned in the rotary steerable system 109 such that zero, one, two, or any other suitable numbers of steering pads are actuated.

Figure 2:
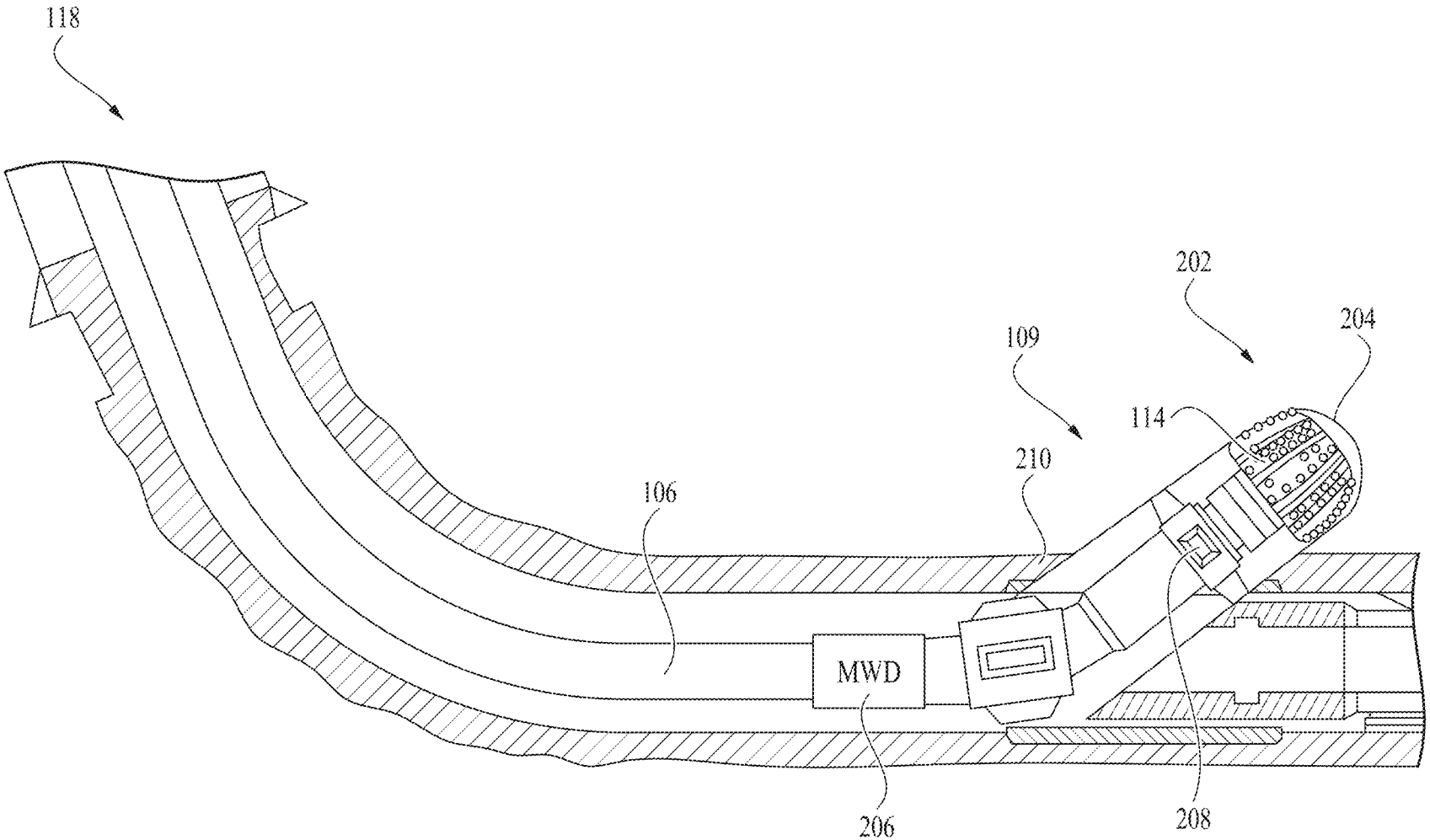
FIG. 2 is a schematic of a wellbore with a rotary steerable system forming a lateral wellbore according to one example of the present disclosure.

FIG. 2 is a schematic of a wellbore 118 with a rotary steerable system 109 steering a drill 202 for forming a lateral wellbore 204 according to one example of the present disclosure. The rotary steerable system 109 can be operably coupled to the drill bit 114, the drill-string 106, a measurement device 206, any other suitable component of a drilling operation, or any suitable combination thereof. For example, and as illustrated, the rotary steerable system 109 is coupled to the drill 202, which includes the drill bit 114, the drill-string 106, and the measurement device 206, which is depicted as a measuring-while-drilling (MWD) device.

The rotary steerable system 109 can be used to change a direction of the drill 202. For example, the steering valve can cause one or more steering pads, such as steering pad 208, to actuate (e.g., outward). By actuating, the steering pad 208 may apply a steering force against a wall of the wellbore 118. For example, the rotary steerable system 109 can cause the steering pad 208 to actuate for causing the drill 202 to change trajectory, for example away from the wellbore 118, for forming the lateral wellbore 204. In some examples, the rotary steerable system 109 may progress through an aluminum casing exit joint 210.

The rotary steerable system 109 may prevent the steering pad 208, and other steering pads included in the rotary steerable system 109, from actuating while the rotary steerable system 109 is passing through the aluminum casing exit joint 210. The aluminum casing exit joint 210 may be fragile or may otherwise be susceptible to damage, for example from an actuated steering pad of the rotary steerable system 109. The rotary steerable system 109 can cause the steering valve to prevent fluid from flowing to the steering pads of the rotary steerable system 109 to prevent the steering pads from actuating. Accordingly, the steering pads of the rotary steerable system 109 can be deactivated by the steering valve while the rotary steerable system 109 passes through the aluminum casing exit joint 210, and the aluminum casing exit joint 210 may not incur damage.

Figure 3:
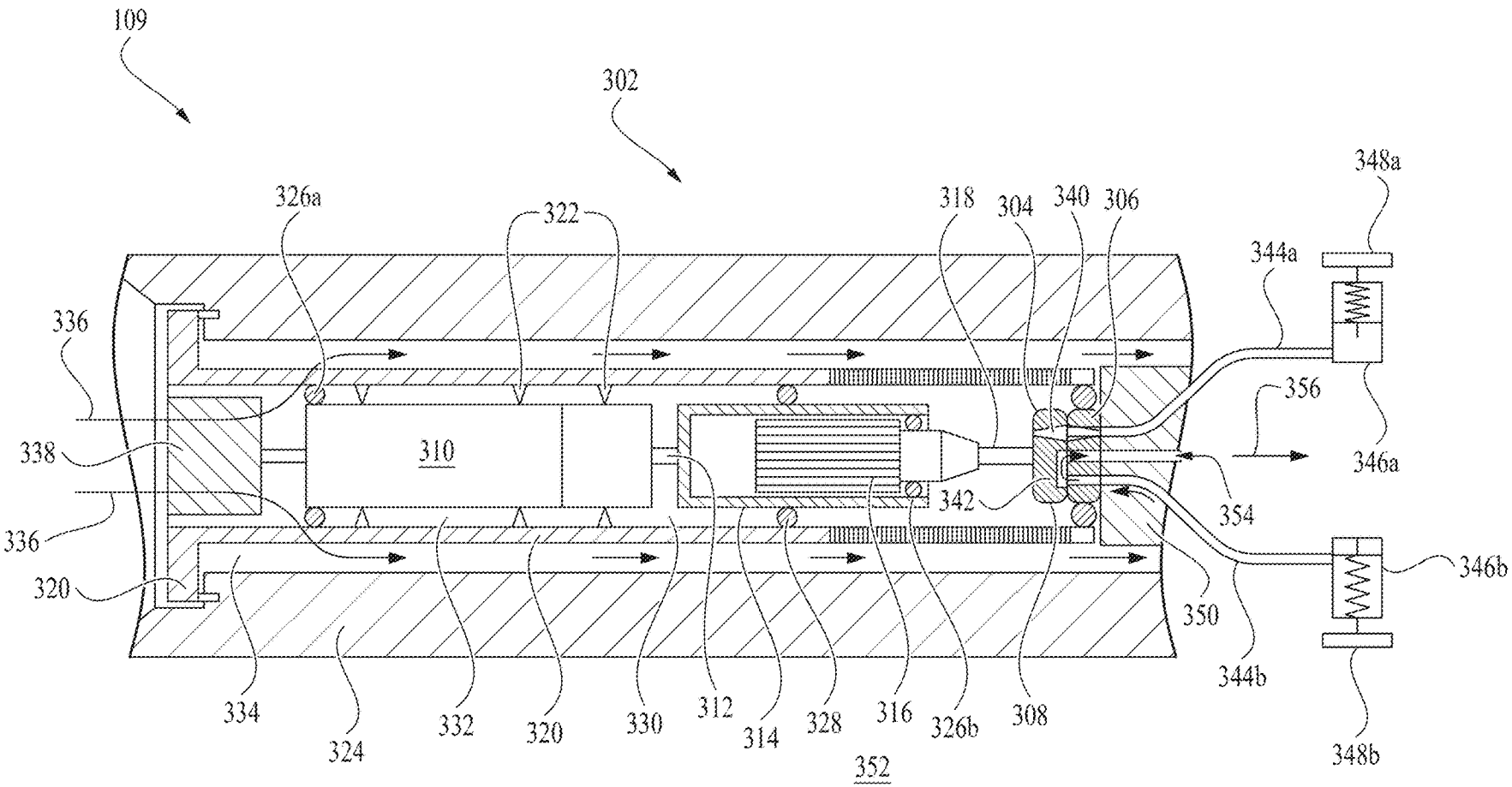
FIG. 3 is a sectional side-view of a rotary steerable system with a steering valve according to one example of the present disclosure.

FIG. 3 is a sectional side-view of a rotary steerable system 109 with a steering valve according to one example of the present disclosure. The rotary steerable system 109 can include a steering valve actuation unit 302 with a steering valve 304 that is engaged with a valve seat 306. An end 308 of the steering valve 304 engages the valve seat 306 while the steering valve 304 is rotated relative to the valve seat 306 by a motor 310. The motor 310 can be any suitable device that can control rotation of the steering valve 304 such as a mud motor, electric motor, turbine motor, actuator, etc. As illustrated, the motor 310 is coupled with a drive shaft 312 coupled to the steering valve 304 via a splined hub 314 which is mated to a splined shaft 316. The splined shaft 316 can be attached to a support structure 318 on which the steering valve 304 is mounted. Thus, rotating the drive shaft 312 can rotate the steering valve 304 relative to the valve seat 306.

The motor 310 can be mounted within a valve housing 320 via supports 322, with the valve housing 320 mounted within a tool housing 324, as shown. Accordingly, the motor 310 can be coupled to the valve seat 306 via the valve housing 320, since a manifold (not shown) can be attached to the valve housing 320 and the tool housing 324. The valve seat 306 can be fixedly attached or otherwise coupled to the manifold which can permanently align ports in the valve seat 306 with flow paths in the manifold. Thus, the tool housing 324, the valve housing 320, the motor 310, the valve seat 306, and the manifold, etc., rotate with the drill bit 114. The motor 310 can rotate the drive shaft 312 relative to the valve housing 320, thereby rotating the steering valve 304 relative to the valve seat 306. It should be noted that the steering valve 304 and valve seat 306 can be held in engagement with each other by an engagement force.

Seals 326 *a-b* and compensation piston 328 can seal off a volume 330 within the valve housing 320 that can contain clean oil 332 for lubricating moving parts of the steering valve actuation unit 302 included in the volume. The clean oil 332 can be separated from the drilling mud 334 by the seals 326 *a-b* and the compensation piston 328 to prevent damage of drive components, such as the motor 310, the splined hub 314, and the shaft 316, due to degrading elements, abrasive particulates, corrosive agents, caustic chemicals, in the drilling mud. The seal 326 *a* can be a stationary seal that seals between the motor 310 and the valve housing 320. The compensation piston 328 can seal between the valve housing 320 and the splined hub 314 that rotates relative to the valve housing 320. But, the compensation piston 328 can also rotate with the splined hub 314 while maintaining a seal with the valve housing 320 that does not rotate with the splined hub 314. The compensation piston 328 can also provide pressure equalization between the volume 330 and the drilling mud 334 by providing pressure communication between the volume 330 and the drilling mud 334. The seal 326 *b* can rotate with the splined hub 314 and the splined shaft 316 when the drive shaft 312 rotates and can seal between the splined hub 314 and the splined shaft 316. The seals 326 *a-b* and the compensation piston 328 can create the volume 330 that can contain the clean oil 332.

Fluid flow 336 of the drilling mud 334 can flow through a turbine 338, which causes the turbine 338 to rotate. The rotation of the turbine 338 can generate electricity to power an electric drive for rotating the drive shaft 312. The turbine 338 can also provide rotation of the drive shaft 312 directly or through various other motor configurations to control the steering valve actuation unit 302. As the drive shaft 312 rotates, the splined hub 314 coupled to the splined shaft 316 can transfer the rotational motion of the drive shaft 312 to rotational motion of the steering valve 304. As the steering valve 304 rotates relative to the valve seat 306, a gap 340 and recess 342 can selectively align with flow paths 344*a-b* or more, if applicable. As illustrated, the gap 340 can be aligned with the flow path 344*a*, which can allow the pressurized drilling mud 334 to enter the flow path 344 *a* via a port or channel in the valve seat 306, which can pressurize a first actuator, such as piston 346*a*, to extend an extendable pad 348*a* (which can serve as a steering pad similar to 208 in some embodiments). A second flow path 344*b* can be aligned with the recess 342, which can direct fluid flow 350 from the second flow path 344*b* to be released to the annulus 352 or other low-pressure volume via flow path 354 as fluid flow 356, which may deactivate a second actuator, illustrated as piston 346*b*, and retracting pad 348*b*. As the steering valve 304 rotates, the gap 340 can miss-align from the flow path 344 *a* and align with the second flow path 344*b*, thereby pressurizing the piston 346*b* to extend the pad 348 *b*, and allowing the piston 346*a* to depressurize via the recess 342 and the flow path 354 to the annulus 352. Accordingly, the extendable pad 348*a* can retract. The selective activation of the pistons 346*a-b*, or more if applicable, can selectively extend and retract the pads 348*a-b*, or more if applicable.

Figure 4:
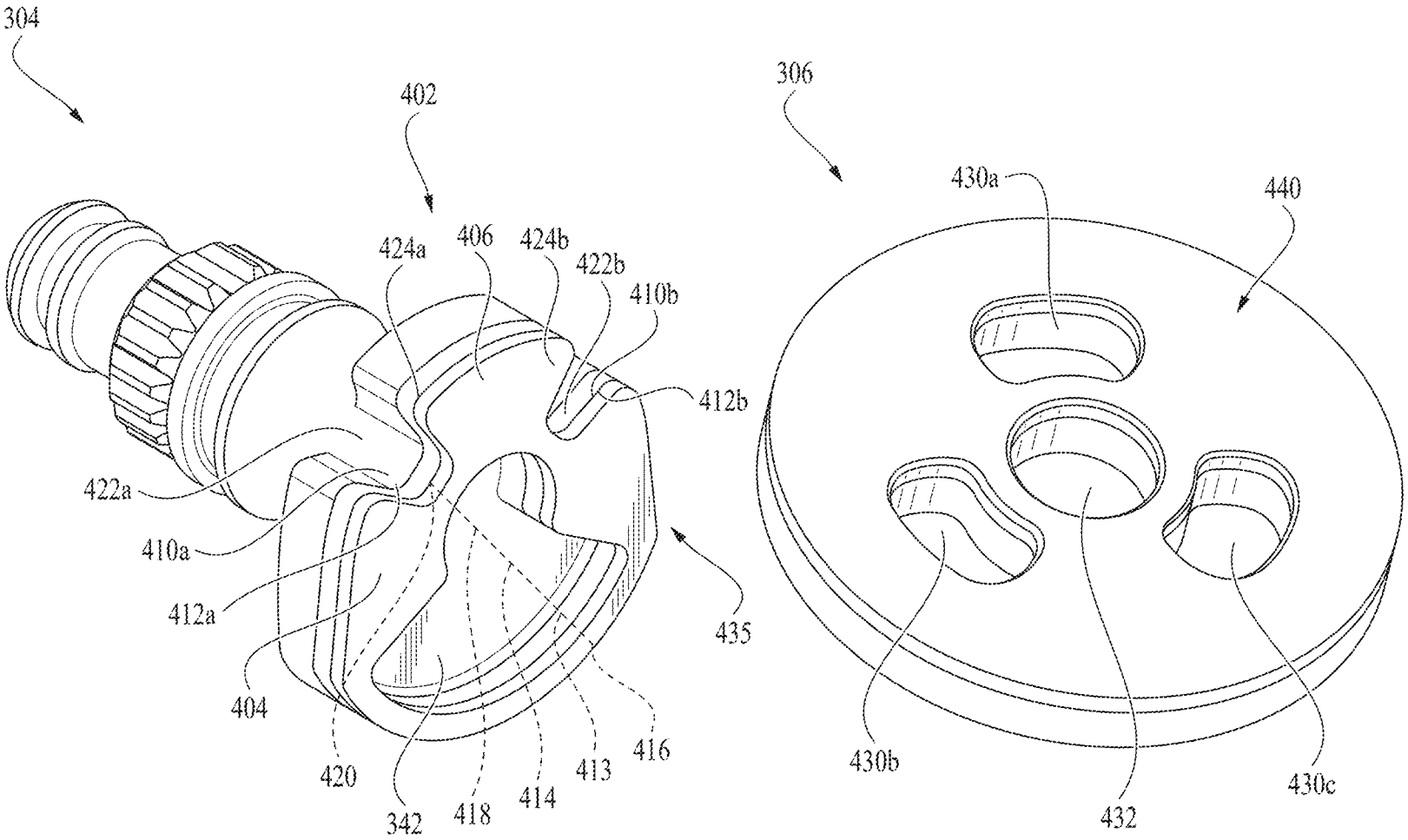
FIG. 4 is an exploded isometric view of a steering valve and a valve seat according to one example of the present disclosure.

FIG. 4 is a perspective view of a steering valve 304 and a valve seat 306 according to one example of the present disclosure. As illustrated, the steering valve 304 includes an open portion 402, a closed portion 404, a cut-off portion 406, and a central channel 408 (which can be part of a recess 342 in some embodiments). The open portion 402 may include a first side 410*a* and a second side 410*b*. The closed portion 404 may include a third side 412*a* and a fourth side 412*b*. In some examples, the open portion 402 and the closed portion 404 can be adjacent or otherwise abutting one another. For example, the first side 410*a* can be adjacent or abutting the third side 412*a*, and the second side 410*b* can be adjacent or abutting the fourth side 412*b*, etc. The open portion 402 can generally allow fluid to flow through corresponding channels of the valve seat 306, while the closed portion 404 may prevent fluid from flowing through the corresponding channels of the valve seat 306. For example, a first radius 413 (or radius range), measured from a center 414 of the steering valve 304 to a circumference 416 of the steering valve 304 associated with the closed portion 404, may be greater than a second radius 418 measured from the center 414 of the steering valve 304 to a circumference 420 of the steering valve 304 associated with the open portion 402. The second radius 418 (or radius range) can expose the corresponding channels 430 of the valve seat 306 and allow fluid to flow through the corresponding channels 430 when the open portion 402 with the second radius 418 is positioned over the corresponding channels 430.

The open portion 402 may additionally include the cut-off portion 406. In some examples, the cut-off portion 406 may divide the open portion 402 into a first flow portion 422*a* and a second flow portion 422*b*. The first flow portion 422 *a* may extend from the first side 410*a* of the open portion 402 to a fifth side 424*a* of the cut-off portion 406, and the second flow portion 42 *b* may extend from a sixth side 424*b* of the cut-off portion 406 to the second side 410 *b* of the open portion 402. The first flow portion 422*a* and the second flow portion 422*b* can allow fluid to flow through corresponding channels 430 of the valve seat 306 (e.g. providing gap 340 for flow to channels). For example, when positioned over the corresponding channels 430, the first flow portion 422*a*, the second flow portion 422*b*, or a combination thereof can expose the corresponding channel 430 and allow fluid to flow to activate one or more steering pads of the rotary steerable system 109 (e.g. the one or more steering pad associated with the corresponding channel(s)). Positioning the cut-off portion 406 over one or more channels 430 of the valve seat 306, however, may not expose the one or more channels 430 and may prevent fluid from flowing to deactivate the steering pads of the rotary steerable system 109. The open portion 402, the closed portion 404, the cut-off portion 406, other suitable components of the steering valve 304, or any suitable combination thereof can be otherwise suitably arranged to allow the steering valve 304 to deactivate steering pads of the rotary steerable system 109.

In some examples, the cut-off portion 406 can be sized to correspond to one or more channels 430 *a-c* of the valve seat 306. For example, a distance, such as a linear distance, an arc length, or the like, of the cut-off portion 406 measured from the fifth side 424*a* to the sixth side 424*b* can be approximately equal to or more than a length (e.g., linear or arc length) of one or more of the channels 430*a-c*. The cut-off portion 406 can be otherwise sized, shaped, or a combination thereof for covering one or more of the channels 430*a-c* for preventing fluid flow to deactivate steering pads of the rotary steerable system 109.

The steering valve 304 can be positioned in the rotary steerable system 109 adjacent to or otherwise abutting the valve seat 306. For example, a first face 435 of the steering valve 304 can be positioned against a second face 440 of the valve seat 306. The first face 435 may physically contact the second face 440. In some examples, the first face 435 may be positioned proximate to (e.g., such that the cut-off portion 406 can prevent flow to one or more of the channels 430*a-c*) but not physically contacting the second face 440. The first face 435 may be otherwise positioned with respect to the second face 440 to allow the steering valve 304 to rotate to selectively activate or deactivate steering pads of the rotary steerable system 109.

In some examples, the steering valve 304 can be positioned with respect to the valve seat 306 such that the central channel 408 is positioned corresponding to a central channel 432 of the valve seat 306 (for example with the first face 435 of the steering valve 304 in proximity to, adjacent to, and/or facing the second face 440 of the valve seat 306). While described as the central channel 408 and the central channel 432, either or both of the central channel 408 and the central channel 432 can be positioned non-centrally with respect to the steering valve 304, the valve seat 306, or a combination thereof. Typically, the center channels may be located radially inward of (e.g. central to) the channels 430*a-c*. In some embodiments, the central channel 408 can receive fluid flowing from the steering pads (e.g. via interaction of the channels 430*a-c* with the recess 342 in the first face 435 of the steering valve 304) and/or the central channel 432. For example, when the steering valve 304 is positioned to deactivate each of the steering pads of the rotary steerable system 109, fluid from the steering pads may be returned to the surface or otherwise removed from the steering pads to allow the steering pads to deactivate. In some embodiments, the fluid can be removed from the steering pads (e.g. through the recess 342, which in FIG. 4 includes the central channel 408 of the steering valve) through the central channel 432 of the valve seat 306 and/or the central channel 408 of the steering valve 304. In some embodiments, the fluid can be retained in the steering valve 304, can be returned to the surface, can be bled to the annulus, or can be otherwise disposed subsequent to removing the fluid from the steering pads.

Figure 5:
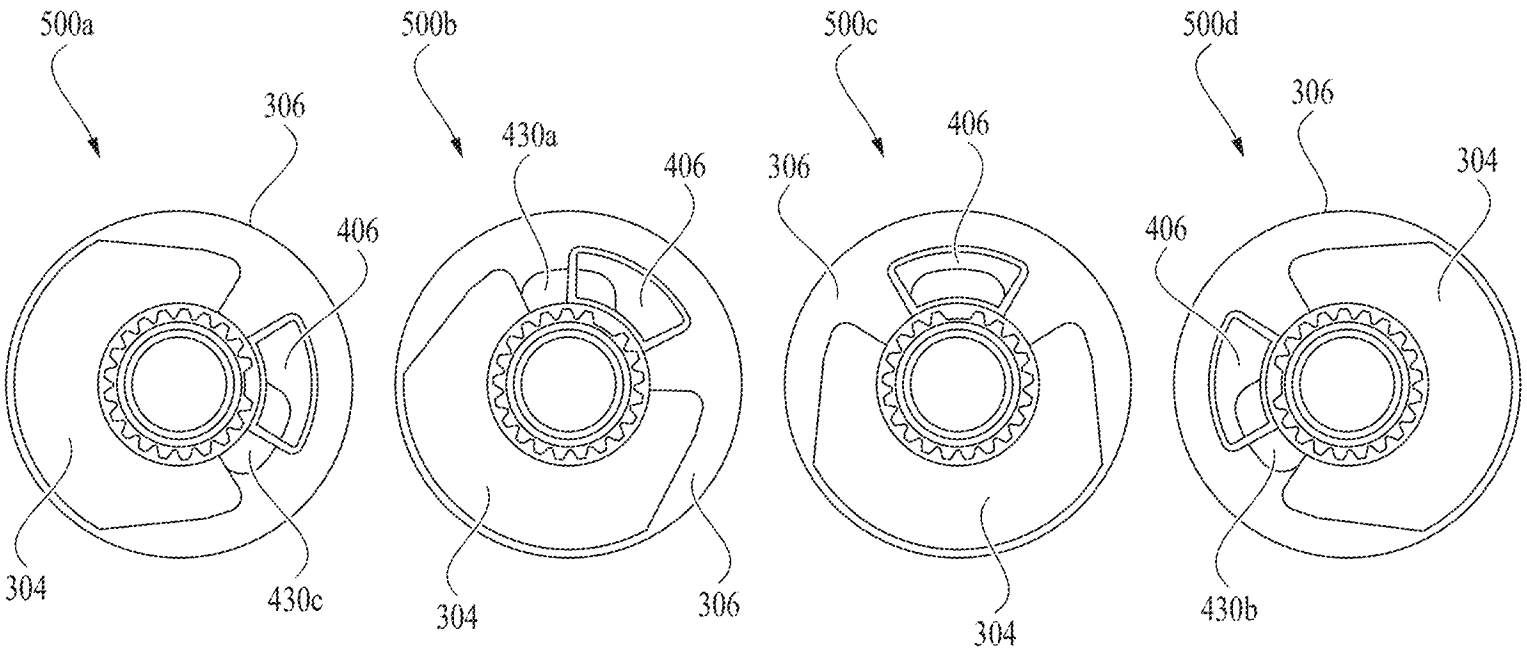
FIG. 5 is a sequence of positions of the steering valve with respect to the valve seat according to one example of the present disclosure.

FIG. 5 is a sequence of positions 500*a-d* of the steering valve 304 with respect to the valve seat 306 according to one example of the present disclosure. As illustrated, the position 500*a* involves the steering valve 304 positioned on the valve seat 306 such that the cut-off portion 406 of the steering valve 304 is partially covering the channel 430*c* of the valve seat 306. Accordingly, the steering valve 304 may allow fluid to flow through the channel 430*c* while the channel 430*c* is at least partially exposed. Additionally, while the cut-off portion 406 partially covers the channel 430*c*, the steering valve 304 may allow a steering pad of the rotary steerable system 109 and corresponding to the channel 430*c* to receive fluid to activate and actuate outward to cause the rotary steerable system 109 to adjust a direction of a drill 202 in the wellbore 118.

In some examples, the open portion 402 of the steering valve 304 may allow 180° of opening with respect to a channel. Stated differently, once the steering valve 304 is rotated to initially expose the channel 430*c* (or other suitable channels of the valve seat 306), the steering valve 304 can be rotated in the same initial direction by approximately 180° before the channel 430*c* is covered by the closed portion 404 of the steering valve 304. The cut-off portion 406 can be positioned within the 180° of the open portion 402, but the cut-off portion 406 can allow one or more channels 430 of the valve seat 306 to be at least partially exposed. For example, the cut-off portion 406 may be sized, shaped, or a combination thereof to cover a corresponding channel 430 of the valve seat 306 in a particular azimuthal configuration of the steering valve 304. In one such example, the cut-off portion 406 can completely cover a particular channel of the valve seat 306 at one angle (or one range of angles) measure of the steering valve 304. The angle measure of the steering valve 304 can be sufficiently small to allow, upon rotating the steering valve 304 in either direction, one or more channels of the valve seat 306 to be at least partially exposed.

As illustrated, the position 500*b* involves the steering valve 304 positioned on the valve seat 306 such that the cut-off portion 406 of the steering valve 304 is partially covering the channel 430*a* of the valve seat 306. Accordingly, the steering valve 304 may allow fluid to flow through the channel 430*a* while the channel 430*a* is at least partially exposed. In some examples, an azimuthal orientation of the steering valve 304 can be adjusted so that two or more channels (e.g., the channel 430*a* and the channel 430*c*, etc.) are partially exposed for allowing fluid flow through the two or more channels. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118.

The position 500*c* may involve the cut-off portion 406 completely covering a corresponding channel, for example the channel 430*a*, of the valve seat 306. The steering valve 304 can be rotated, for example from the position 500*a*, the position 500*b*, or the like, to be orientated in the position 500*c*. The cut-off portion 406, in the position 500*c*, may prevent fluid from flowing through the corresponding channel. Accordingly, the cut-off portion 406 in the position 500*c* may deactivate a steering pad of the rotary steerable system 109 that corresponds to the corresponding channel. In some examples, the closed portion 404 of the steering valve 304 in the position 500*c* may cover the remaining channels of the valve seat 306. Thus, by positioning the cut-off portion 406 to prevent flow of fluid to the corresponding channel, the steering valve 304 can deactivate each of the steering pads included in the rotary steerable system 109.

As illustrated, the position 500*d* involves the steering valve 304 positioned on the valve seat 306 such that the cut-off portion 406 of the steering valve 304 is partially covering the channel 430*b* of the valve seat 306. Accordingly, the steering valve 304 may allow fluid to flow through the channel 430*b* while the channel 430*b* is at least partially exposed. In some examples, an azimuthal orientation of the steering valve 304 can be adjusted so that two or more channels (e.g., the channels 430*a-b*, etc.) are partially exposed for allowing fluid flow through the two or more channels. Additionally, while the cut-off portion 406 partially covers the channel 430*b*, the steering valve 304 may allow a steering pad of the rotary steerable system 109 and corresponding to the channel 430 *b* to receive fluid to activate and actuate outward to cause the rotary steerable system 109 to adjust a direction of a drill 202 in the wellbore 118. Other suitable positions of the steering valve 304 are possible, and the steering valve 304 can partially or completely cover zero, one, two, three, or more channels that may be included in the valve seat 306 positioned adjacent to the steering valve 304.

Figure 6:
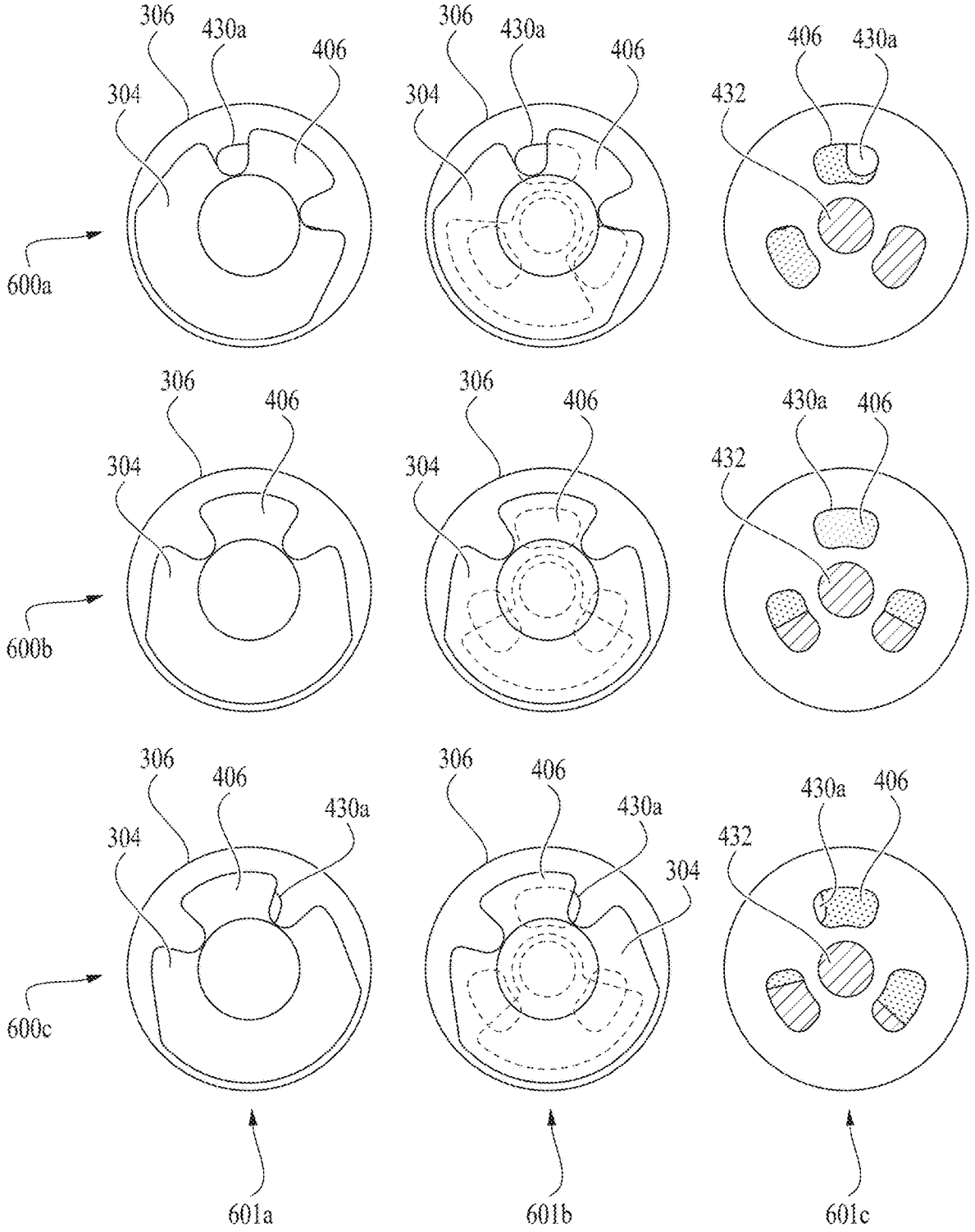
FIG. 6 is a sequence with different views of positions of the steering valve with respect to the valve seat according to one example of the present disclosure.

FIG. 6 is a sequence with different views 601*a-c* of positions 600*a-c* of the steering valve 304 with respect to the valve seat 306 according to one example of the present disclosure. As illustrated, FIG. 6 includes the positions 600*a-c*, which are arranged horizontally as rows, and the different views 601*a-c*, which are arranged vertically as columns. For example, portions of FIG. 6 in a common row (e.g., corresponding to the position 600*a*, etc.) involve different views of a similar position, and portions of FIG. 6 in a common column (e.g., corresponding to one or more views included in the views 601*a*, etc.) involve a similar view of different positions. Additionally, while FIG. 6 is illustrated with respect to the channel 430*a*, similar positions and views are possible for other channels, such as the channels 430*b-c*, etc., of the valve seat 306.

As illustrated, the position 600*a* involves the steering valve 304 positioned on the valve seat 306 such that the cut-off portion 406 of the steering valve 304 is partially covering the channel 430*a* of the valve seat 306. The views 601 *a* include a top-view of the position 600*a*, the views 601*b* include a transparent top-view of the position 600*a*, and the views 601*c* include a bottom-view of the position 600*a*. In the position 600*a*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430*b-c* to be deactivated.

The position 600*b* may involve the cut-off portion 406 completely covering the channel 430*a* of the valve seat 306. The views 601 *a* include a top-view of the position 600*b*, the views 601*b* include a transparent top-view of the position 600*b*, and the views 601*c* include a bottom-view of the position 600*b*. The steering valve 304 can be rotated, for example from the position 600*a* to the position 600*b*. The cut-off portion 406, in the position 600*b*, may prevent fluid from flowing through the channel 430*a*. Accordingly, the cut-off portion 406 in the position 600*b* may deactivate a steering pad of the rotary steerable system 109 that corresponds to the channel 430*a*. In some examples, the closed portion 404 of the steering valve 304 in the position 600*b* may cover the remaining channels 430*b-c* of the valve seat 306. Thus, by positioning the cut-off portion 406 to prevent flow of fluid to the channel 430*a*, the steering valve 304 can deactivate each of the steering pads included in the rotary steerable system 109.

As illustrated, the position 600*c* involves the steering valve 304 positioned on the valve seat 306 such that the cut-off portion 406 of the steering valve 304 is partially covering the channel 430*a* (e.g., a different side of the channel 430*a* compared to the position 600*a*) of the valve seat 306. The views 601*a* include a top-view of the position 600*c*, the views 601*b* include a transparent top-view of the position 600*c*, and the views 601*c* include a bottom-view of the position 600*c*. In the position 600*c*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430*b-c* to be deactivated.

The rotary steerable system 109 can be coupled to a drill 202 and other suitable components of a drilling operation. The rotary steerable system 109 can be used to form a wellbore 118. For example, the rotary steerable system 109 can control a direction of the drill 202 to control a shape, depth, or other parameters relating to the wellbore 118 being formed. The rotary steerable system 109 can include one or more steering pads that can be activated or deactivated. For example, fluid can be injected into the subterranean formation or the wellbore 118 to cause the fluid to be directed to one or more of the steering pads of the rotary steerable system 109. A steering pad that receives the fluid can actuate outward to apply a steering force against a wall of the wellbore 118 or other suitable structure. The steering force can cause the direction of the drill 202 to change.

In embodiments, an orientation of the steering valve 304 can be adjusted to deactivate at least one steering pad of the rotary steerable system 109. The steering valve 304 can be rotated or otherwise be positioned such that an orientation of the steering valve 304 causes each of the channels of the valve seat 306 to be covered by the steering valve 304. For example, a continuous closed portion of the steering valve 304 can be positioned to cover each of the channels of the valve seat 306 to deactivate each of the steering pads of the rotary steerable system 109. In other examples, a cut-off portion 406 of the steering valve 304 can be positioned over at least one channel of a valve seat 306 positioned adjacent to the steering valve 304 while the closed portion 404 covers the remaining channels of the valve seat 306. The at least one channel may correspond to at least one steering pad of the rotary steerable system 109. For example, fluid that flows through the at least one channel may be directed to the at least one steering pad for activating the steering pad. But, the cut-off portion 406 may prevent fluid from flowing through the at least one channel. Additionally, the orientation of the steering valve 304 may involve a closed portion 404 of the steering valve 304 covering the remaining channels of the valve seat 306. Accordingly, the steering pads of the rotary steerable system 109 may be deactivated by the steering valve 304 in the present orientation.

In some examples, the steering valve 304 can be used as a non-steering valve. For example, the steering valve 304 can be coupled to a drill string or other suitable component of a drilling operation that may rotate to cause the drill 202 to rotate. The steering valve 304 can be positioned such that the steering pads are deactivated and such that the steering valve 304 is held stationary with respect to the drill string or other suitable component. Accordingly, the cut-off portion 406 of the steering valve 304 can be held stationary to deactivate one or more of the steering pads for an extended period of time, which may be predetermined.

In some examples, downhole electronics can control the steering valve 304. For example, the rotary steerable system 109 or other suitable components communicatively coupled to the rotary steerable system 109 can include sensors that can indicate one or more locations of the rotary steerable system 109 or any suitable component thereof such as a steering pad. Based on sensor signals, a motor that can control the steering valve 304 can be controlled to cause the steering valve 304 to adjust orientation. For example, the sensors may indicate that a tool face angle of the drill 202 should be adjusted, and the motor can be controlled to cause the steering valve 304 to rotate or otherwise change orientations to deactivate or activate corresponding steering pads to achieve the tool face angle adjustment.

In some examples, the valve seat 306 may include channels that are radially offset, azimuthally offset, or a combination thereof. For example, the channels of the valve seat 306 may be equally or unequally distributed azimuthally around the valve seat 306 on a similar radius. In other examples, the channels may be similarly shaped or sized and may be positioned on different radii of the valve seat 306. In yet other examples, the radial position and the azimuthal position of the channels of the valve seat 306 may be different among each channel of the valve seat 306. In any of the preceding examples, the steering valve 304, or any component or components thereof, such as the open portion 402, the closed portion 404, the cut-off portion 406, etc., may be designed or otherwise arranged to be used with the corresponding design of the channels of the valve seat 306 to deactivate the steering pads of the rotary steerable system 109. In some of these examples, the steering valve 304 may include more (e.g., more than three portions may be included with respect to the steering valve 304) or fewer (e.g., one or more of the open portion 402, the closed portion 404, or the cut-off portion 406 may be omitted) portions.

In embodiments, an orientation of the steering valve 304 can be adjusted to activate at least one steering pad of the rotary steerable system 109. The steering valve 304 can be rotated or otherwise be positioned such that an orientation of the steering valve 304 causes the open portion 402 of the steering valve 304 to at least partially expose at least one channel of the valve seat 306. In other examples, an orientation of the cut-off portion 406 of the steering valve 304 can be positioned partially over (or partially not over) at least one channel of a valve seat 306 positioned adjacent to the steering valve 304. The at least one channel may correspond to at least one steering pad of the rotary steerable system 109. For example, fluid that flows through the at least one channel may be directed to the at least one steering pad for activating the steering pad. And, the orientation of the steering valve 304 may allow fluid to flow through the at least one channel. Accordingly, the at least one steering pad of the rotary steerable system 109 may be activated by the steering valve 304 in the present orientation and may actuate for controlling a direction of the drill 202.

In some rotary steerable drilling system embodiments, pressure relief can be an issue, for instance when the steering valve is oriented to deactivate all of the steering pads (e.g. blocking high-pressure fluid flow to all steering pads, for example during a non-steering phase of drilling (e.g. zero duty cycle, drilling through the shoe, off bottom cleaning, etc.)). For example, in an exemplary 3-pad rotary steerable drilling system design (e.g. similar to those described above) in which all steering pads have been deactivated, the fluid pressure (e.g. remaining after an activate pad is deactivated) from two of the steering pads can be bled to annulus, for example through a bypass port, while the pressure inside the third pad may be expected to bleed to annulus through the seal gap between piston and cylinder. In some instances, this approach could be problematic, for example if the small seal gap becomes plugged up. For example, if bleeding of the high-pressure fluid in the third pad is prevented or limited by a plugged seal gap, the trapped volume could have higher pressure that can cause seal stress and/or valve chattering. This could impact durability, reliability, and/or service life of the steering pad mechanism and/or the rotary steerable drilling system as a whole (for example due to unwanted pressure spikes) and/or could impact steering effectiveness (for example if the plugged pad does not retract at the proper rate) and/or drilling performance. Disclosed embodiments may address one or more of these issues, for example with a configuration that may improve bleed-off from the third steering pad.

Figure 7:
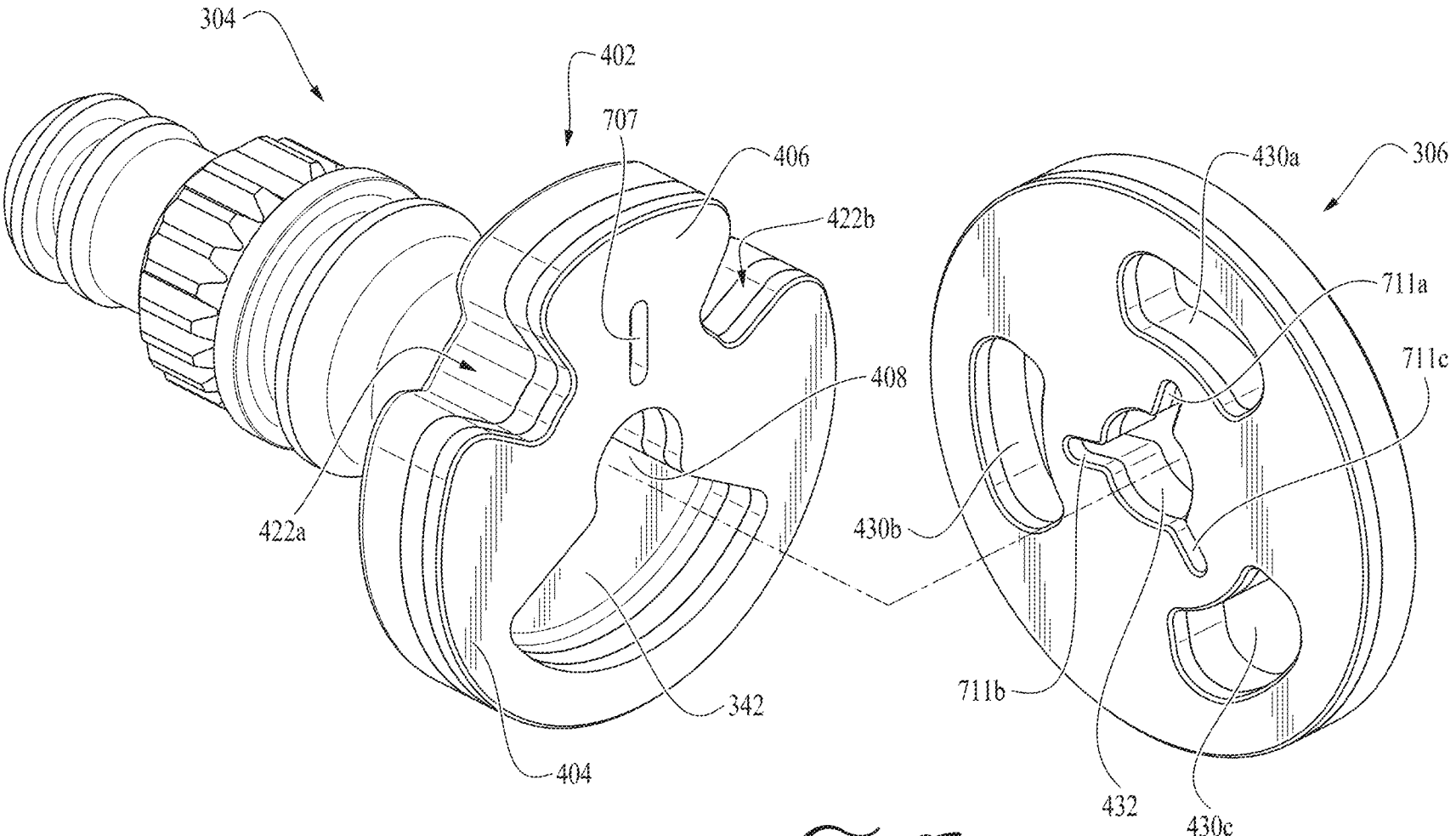
FIG. 7 is an exploded isometric view of a system having a steering valve and a valve seat according to one example of the present disclosure.
Figure 8:
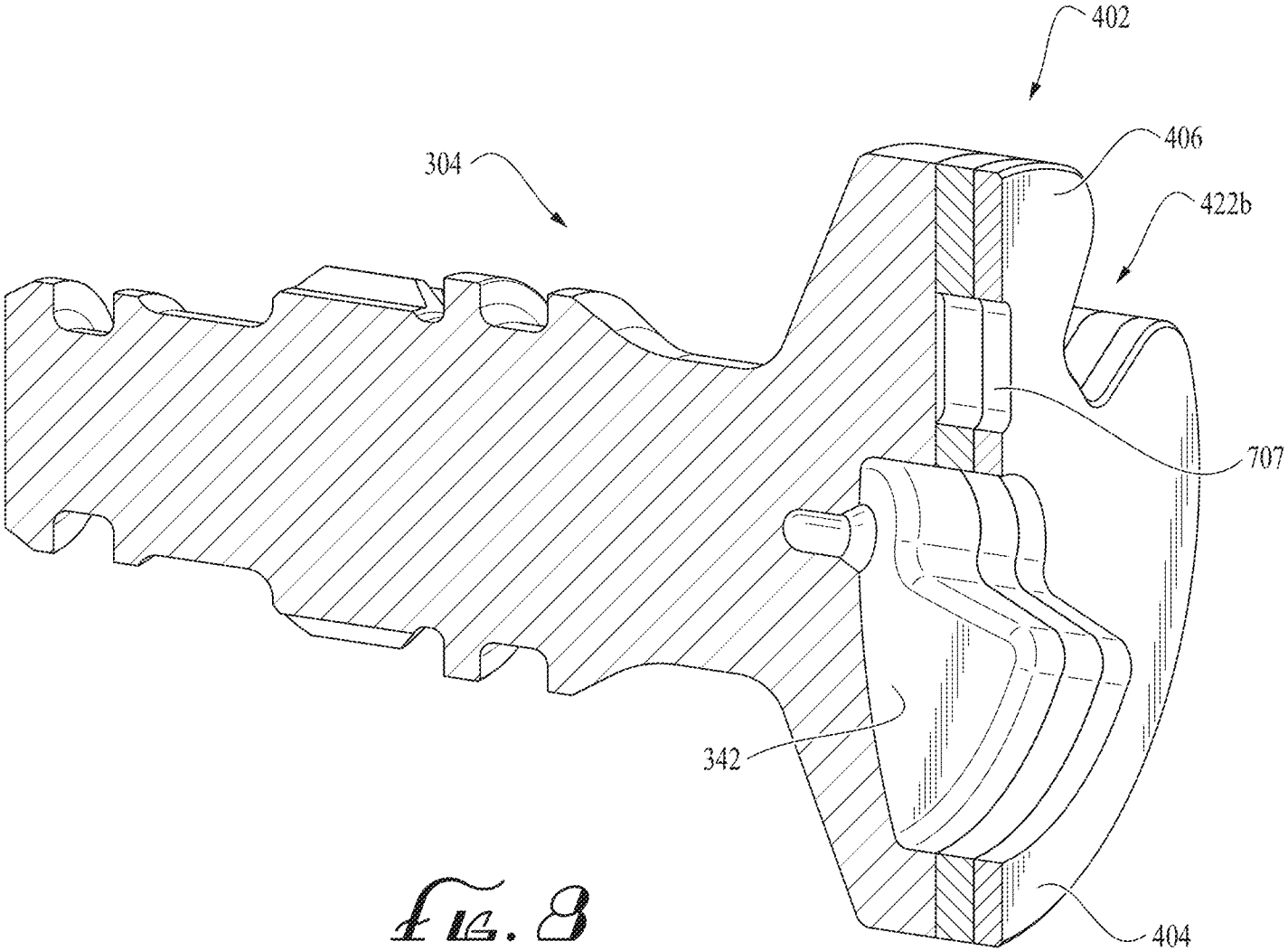
FIG. 8 is a cross-sectional isometric view of the steering valve of FIG. 7 according to one example of the present disclosure.
Figure 9A:
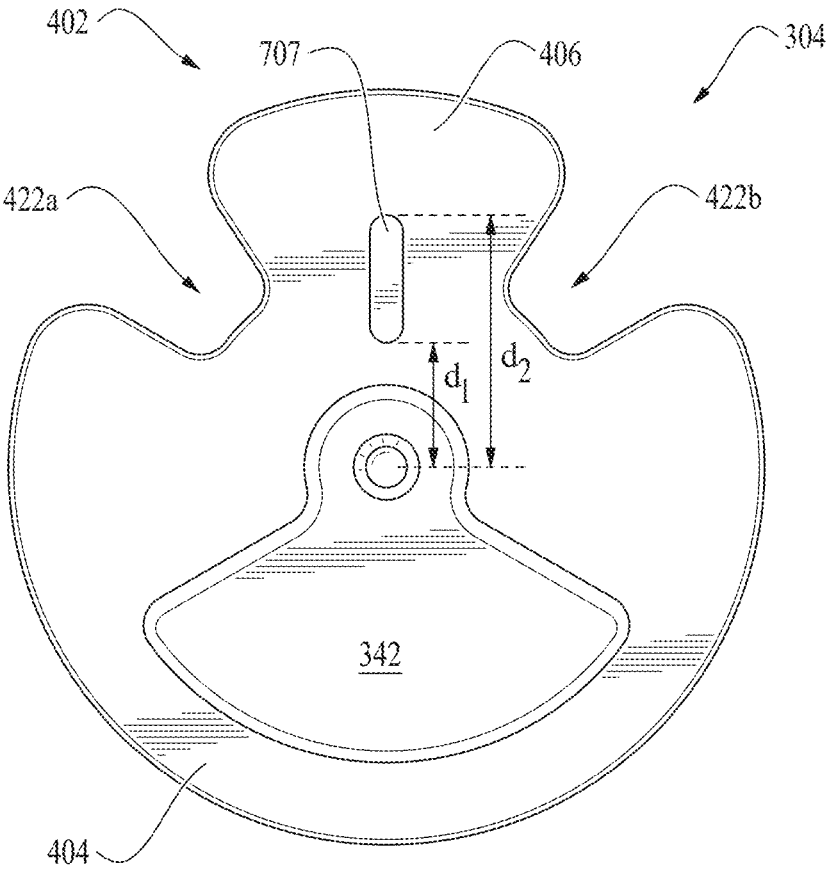
FIG. 9A is a plan view of a first face of the steering valve of FIG. 7 according to one example of the present disclosure.
Figure 9B:
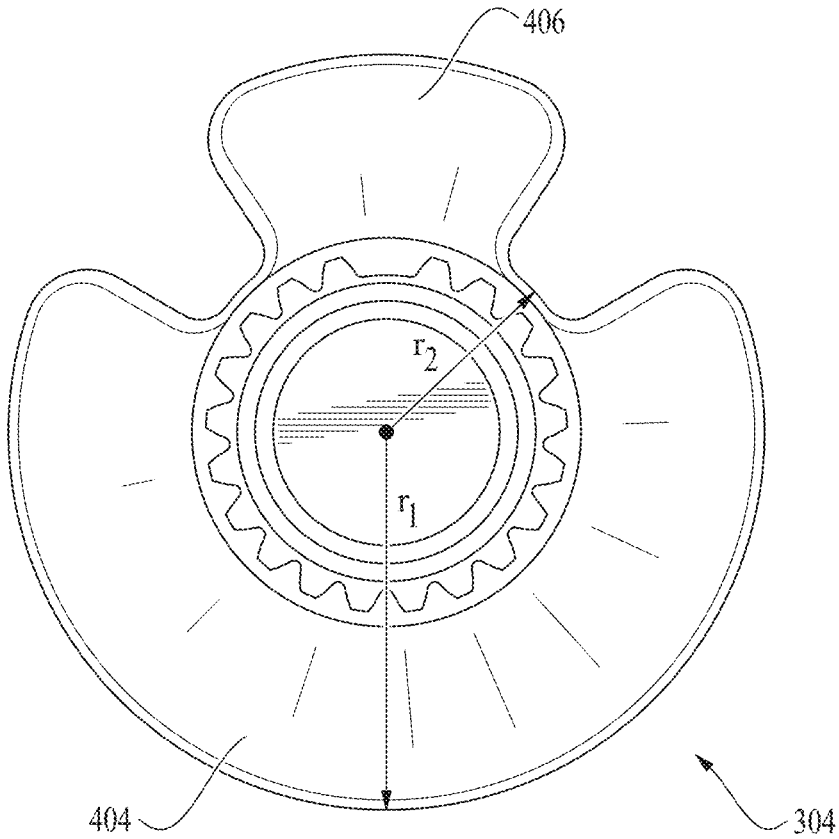
FIG. 9B is a plan view of an opposite face of the steering valve of FIG. 7 according to one example of the present disclosure
Figure 10:
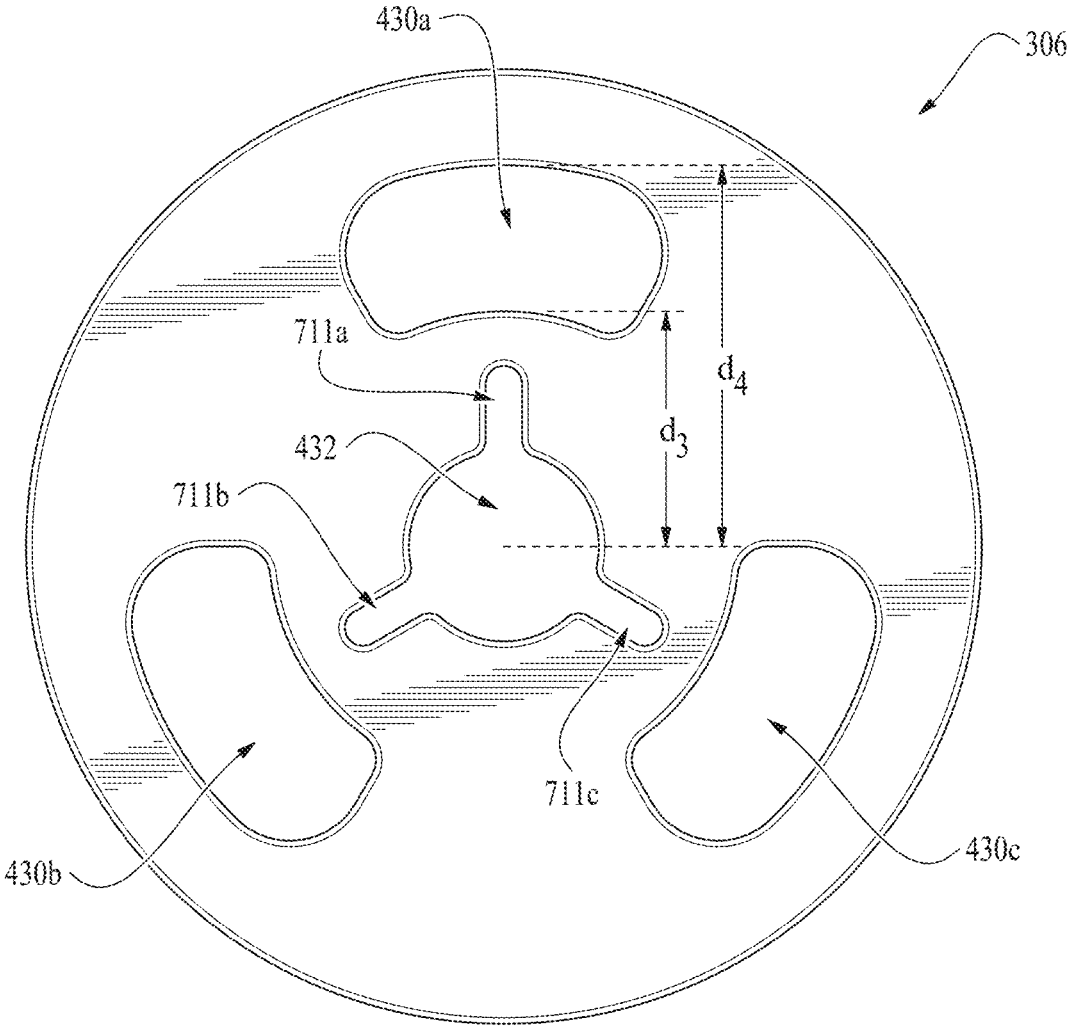
FIG. 10 is a plan view of the valve seat of FIG. 7 (e.g. of its second face) according to one example of the present disclosure.

FIG. 7 illustrates another embodiment of a steering system for a rotary steerable drilling system, and FIG. 8 further illustrates the system of FIG. 7 with a cut-away view of the steering valve. FIG. 9A illustrates a plan view of the first face of the steering valve of FIG. 7, while FIG. 9B illustrates a plan view of the opposite face. FIG. 10 illustrates a plan view of the valve seat of FIG. 7. The system in FIG. 7 can be similar in many ways to earlier embodiments, but can further include one or more pressure relief feature.

In the embodiment of FIG. 7, pressure relief (e.g. for the third pad) can be provided by a blind notch recess in the steering valve 304 and radially extending notches corresponding to each of the plurality of channels in the valve seat 306. These can be configured so that, when the steering valve 304 is oriented to block fluid flow to all steering pads (e.g. to cover all of the plurality of channels), one of the notches (e.g. corresponding to the channel for the third steering pad) overlaps with the blind notch recess to allow bleed-off of pressure therethrough. For example, the pressurized fluid in such a third steering pad may bleed-off into the recess of the steering valve 304, and thereby through the central channel of the valve seat 306 to the annulus.

Turning now to FIG. 7 in more detail, an exemplary system (e.g. for controlling steering pads of a rotary steerable drilling system) can comprise an exemplary valve seat 304 and an exemplary steering valve 306, which can be configured to interact together to control flow of pressurized fluid with respect to the steering pads 348 (e.g. which can be similar to 208 in some embodiments). The valve seat 306 can have a central channel 432 therethrough and a plurality of (e.g. pad activation) channels 430 (e.g. 430*a-c* in FIG. 7) therethrough, with each of the plurality of (e.g. activation) channels 430 corresponding to (e.g. in fluid communication with) one of the steering pads 348 (see FIG. 3 for example). For example, fluid flow through the channels 430 can control activation/deactivation (e.g. radial extension) of the steering pads 348 during operation of the rotary steering drilling system. In the embodiment of FIG. 7, the channels 430 can encircle and/or be disposed radially outward from the central channel 432 (e.g. with the central channel 432 disposed between the plurality of channels 430).

The steering valve 304 can include a closed portion 404 and an open portion 402, which can be (e.g. circumferentially) adjacent and/or abutting. In embodiments, the open portion 402 can comprise a cut-off-portion 406, a first flow portion 422*a*, and a second flow portion 422*b*. In FIG. 7, the cut-off portion 406 is disposed between the first and second flow portions 422*a,b*. In some embodiments, the steering valve 304 can be configured with a generally circular shape (e.g. for its first face 435), with the closed portion 404 comprising an unbroken/continuous portion of the generally circular shape and the open portion 402 comprising a broken portion of the circular shape (e.g. with the open portion 402 having one or more gap 340 (e.g. flow portion 422) and the cut-off portion 406 (which can be disposed between the flow portions in some embodiments) forming another portion of the generally circular shape.

In embodiments, the open portion 402 of the steering valve 304 can be configured to allow fluid flow (e.g. fluid passage therethrough) to one or more of the steering pads 348 via the corresponding channels 430 (e.g. based on the rotational position/orientation of the open portion 402 with respect to the valve seat 306). For example, aligning the first and/or second flow portions 422*a,b* with the channels 430 in the valve seat 306 can allow fluid flow to the corresponding steering pad(s), since the first flow portion 422*a* and the second flow portion 422*b* are each configured to allow passage of fluid therethrough (e.g. each comprise a gap 340). In some embodiments, the closed portion 404 of the steering valve 304 can comprise a continuous portion (e.g. which is continuous and/or unbroken, for example configured without fluid passage therethrough). The closed position 404 can be configured to adjustably cover (e.g. based on its rotational position/orientation with respect to the valve seat 306) and thereby close one or more of the channels 430 of the valve seat 306 (e.g. to prevent flow of fluid through the channel(s) 430 and thereby deactivate the corresponding steering pad(s)). Thus, channels 430 in the valve seat 306 can be covered by the closed portion 404 and/or the cut-off portion 406 (e.g. with the closed portion 404 and/or the cut-off portion 406 being aligned with channels 430), while channels 430 in the valve seat can be uncovered/opened by aligning the first and/or second flow portions 422*a,b* with the channels 430.

As shown in FIG. 7, the steering valve 304 can be disposed adjacent to the valve seat 306 (e.g. with the first face 435 of the steering valve 304 adjacent to, in proximity to, abutting, and/or facing the second face 440 of the valve seat 306) and is configured to rotate relative to the valve seat 306. Rotational orientation of the steering valve 304 relative to the valve seat 306 can control flow of fluid through the plurality of channels 430 of the valve seat, for example based on whether and/or the amount that the steering valve 304 blocks/covers one or more of the plurality of channels 430 in the valve seat 306. In embodiments, the valve seat 306 and the steering valve 304 can both be made of hard materials. In some embodiments, the valve seat 306 may comprise harder material than the steering valve 304. For example, the valve seat 306 may comprise diamond and the steering valve 304 may comprise carbon or steel.

In embodiments, the steering valve 304 can comprise a recess 342, which can be disposed in the closed portion 404. In some embodiments, the recess 342 can include a central channel 408 and a flared portion (e.g. the remainder of the recess 342 can be wider than the central channel 408, for example widening as it extends from the central channel 408). Typically, the recess 342 can be disposed in (e.g. sunken in) the first face 435 of the steering valve 3-4, which can be oriented towards the valve seat 306 (e.g. towards the second face 440 of the valve seat 306). The steering valve 305 can also comprise a blind notch recess 707, which can be disposed in the open portion 402 and/or can extend radially in the cut-off portion 406. Typically, the blind notch recess 707 and the recess 342 can be disposed in the same face of the steering valve 305 (e.g. the first face 435) and face towards the valve seat 306. For example, the blind notch recess 707 can be disposed in (e.g. sunken in) the first face of the steering valve 304. As shown in FIG. 7, the blind notch recess 707 and the recess 342 are not connected. For example, they can be separated by a portion of the steering valve body, with the blind notch recess 707 radially outward of the recess 342.

For each of the plurality of channels 420, the valve seat 306 can include a notch 711(e.g. extending through the valve seat) that extends radially outward from the central channel 432. As shown in FIG. 7, the notches 711 can be connected to the central channel 432 of the valve seat 306. For example, each notch 711can be open to the central channel 432 at one end and can extend radially towards, but not intersect, the corresponding (e.g. activation) channel 430—for example, each notch 711 can be separated from the corresponding channel 430 by a portion of the valve seat body. In FIG. 7, there are three channels 430*a,b,c* and three corresponding notches 711*a,b,c* (e.g. with each notch 711 extending radially towards its corresponding channel 430)

In embodiments, the blind notch recess 707 can comprise an inner end (e.g. radial) distance $d_1$ (e.g. which can be disposed radially outward of the recess 342) and an outer end (e.g. radial) distance $d_2$ (e.g. representing the extent to which the blind notch recess 707 extends radially outward), and the outer end (radial) distance $d_2$ is radially outward of the inner end (radial) distance $d_1$. See for example FIG. 9A. In FIG. 7, the outer end distance $d_2$ extends radially outward sufficiently to allow for interaction/overlap with the plurality of channels 430 in the valve seat 306 when properly (e.g. rotationally) oriented. For example, the blind notch recess 707 can extend radially outward beyond an inner channel distance $d_3$ (e.g. the radial location of the inner edge of the channel 430—see for example FIG. 10), or $d_2$ can be greater than $d_3$.

Figure 12:
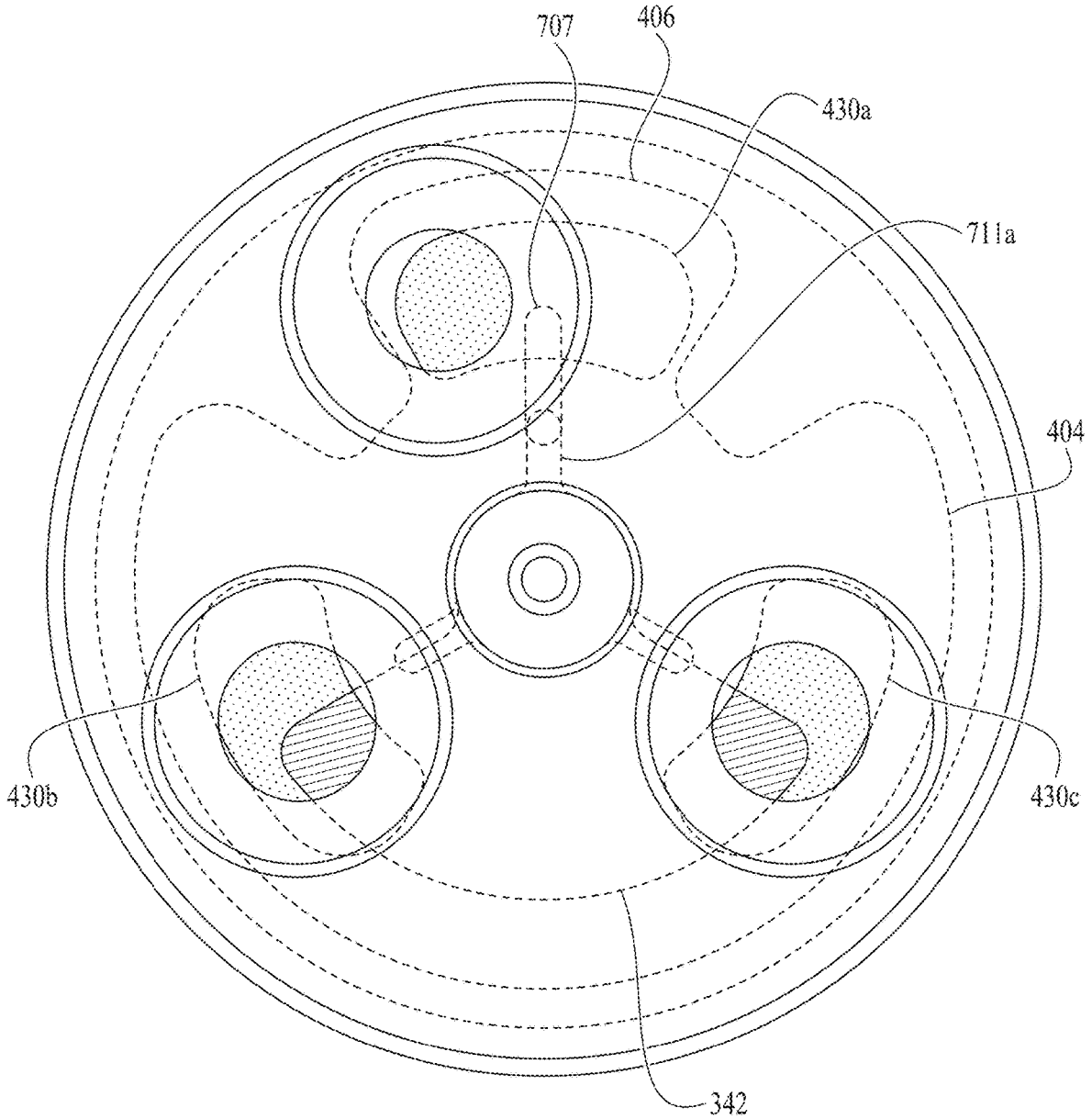
FIG. 12 is a schematic plan view illustrating interaction (such as overlapping) of various components when the steering valve is oriented to cover all channels of the valve seat according to one example of the present disclosure.

In embodiments, each notch 711 of the valve seat 306 can extend radially outward beyond the inner end distance $d_1$ of the blind notch recess 707, but does not extend to the inner channel distance $d_3$ (e.g. a portion of the valve seat body separates each notch from its corresponding channel). This can allow for overlap of the notches 711 with the blind notch recess 707 based on orientation (e.g. when aligned). So in the embodiment of FIG. 7, the blind notch recess 707 can overlap with the channel 430, and the notch 711 (e.g. its distal end) can overlap with the blind notch recess 707 when the steering valve 304 is oriented to cover all of the plurality of channels 430 of the valve seat 306 (see for example FIG. 12). In such orientation, the notch 711 (e.g. its proximal end) and/or the central channel 432 of the valve seat 306 can also overlap with the recess 342 in the steering valve 304. For example, the central channel 432 of the valve seat 306 can overlap with the recess 342 of the steering valve (304 e.g. with the central channel 408 of the steering valve). In such orientation, the steering pad corresponding to the channel 430 covered by the cut-off portion 406 (e.g. the channel corresponding to the notch 711 at issue) can be in fluid communication with the recess 342 and/or the central channel 432 of the valve seat 306.

The steering valve 304 can be configured to be oriented/positioned with respect to the valve seat 306 to control activation/deactivation of the steering pads. For example, the orientation can allow for one pad to be active (e.g. radially extended) while two pads are inactive (e.g. radially retracted), two pads to be active (e.g. radially extended) while one pad is inactive (e.g. radially retracted), or all pads to be inactive (e.g. radially retracted). The specific pads which are active and inactive can be changed based on orientation of the steering valve 304 with respect to the valve seat 306.

As shown in FIG. 7, when the steering valve 304 is rotationally positioned relative to the valve seat 306 to close/cover/block all of the plurality of channels 430 (e.g. as in FIG. 12), one of the notches 711 of the valve seat overlaps with the blind notch recess 707 of the steering valve. For example, in FIG. 12 the specific notch 711*a* extending towards the channel 430*a* that is closed/covered by the cut-off portion 406 overlaps with the blind notch recess 707 in this orientation. The system can be configured to bleed-off fluid pressure from the steering pad which is closed/covered by the cut-off portion 406 when the steering valve 304 is positioned to close all of the plurality of channels 430 in the valve seat 306. For example, fluid pressure from the steering pad corresponding to the channel 430 covered by the cut-off portion 406 can be bled-off through the overlapping blind notch recess 707 and corresponding notch 711*a*. In embodiments, the central channel 432 of the valve seat 306 can be configured to be in fluid communication (e.g. for bleed-off) with one or more of the steering pads based on orientation of the steering valve 304 with respect to the valve seat 306. For example, when the steering valve 304 is oriented relative to the valve seat 306 to cover channels 430 leading to the one or more steering pads (e.g. thereby deactivating the corresponding steering pad(s)), that one or more steering pad 430 can be in fluid communication with the central channel 432 of the valve seat (e.g. for fluid pressure bleed off). Furthermore, when the steering valve 304 covers all of the channels 430 (so all steering pads are deactivated), all of the steering pads can be in fluid communication with the central channel 432 of the valve seat 306. For example, when the steering valve 304 covers all of the channels 430, fluid pressure of one of the steering pads (e.g. the pad corresponding to the channel 430 being covered by the cut-off portion 406) may bleed-off through the blind notch recess 707 and the (e.g. overlapping) corresponding notch 711 in the valve seat to the central channel 432 of the valve seat 306; the fluid pressure of the remaining steering pads (e.g. the steering pads other than that corresponding to the channel being covered by the cut-off portion and/or the steering pads corresponding to the channels 430 covered by the closed portion 404 of the steering valve 304) can bleed-off via overlap of the corresponding channels 430 with the recess 342 in the steering valve (e.g. a portion of each such channel overlaps with and/or is in fluid communication with a portion of the recess, which is in turn in fluid communication with the central channel 432 of the valve seat). In embodiments, fluid pressure is only bled-off in this manner when all of the channels 430 are covered by the steering valve 304 (e.g. in other orientations, bleed-off can be similar to that described with respect to FIGS. 3-6).

As illustrated in FIGS. 7 and 9A, the recess 342 in the steering valve 304 can be (e.g. circumferentially) larger at its distal/radially-outward end. For example, in some embodiments the recess 342 can include a central channel 408 of the steering valve 304, and the recess 342 can flare outward as it extends radially from the central channel 408 of the steering valve and/or away from the open portion 402. In some embodiments, the recess 342 (e.g. its distal end) can overlap with two of the channels 430 in the valve seat 306 when the steering valve 304 is positioned to close all channels 430 (e.g. when the cut-off portion 406 closes one channel and the closed portion 404 closes the other/remaining channels). In some embodiments, the recess 342 can extend through a radial arc of approximately 120 degrees (e.g. at its distal end).

In some embodiments, the blind notch recess 707 and/or each notch 711 can have a rounded end (e.g. for the notch the radially outward end can be rounded, and for the blind notch recess, the radially inward end can be rounded). In some embodiments, both ends can be rounded. The amount of overlap of the notch 711 with the blind notch recess 707 can be configured to prevent or minimize clogging. In some embodiments, the amount of overlap of the notch 711 with the blind notch recess 707 can be approximately equal to the width of the blind notch recess 707 and/or the notch 711 (e.g. the notch and blind notch recess may have approximately the same width, and the radial overlap may be approximately the same amount/diameter as that width and/or may be no less than that width). In some embodiments, the overlap of the notch 711 and the blind notch recess 707 may be approximately circular, for example with a diameter no less than approximately 0.06 inch, no more than approximately 0.125 inch, or approximately 0.09 inch.

In embodiments, the radial distance $d_5$ between each notch 711 and its corresponding channel 430 in the valve seat can be no less than approximately ⅛ inch. In embodiments, the notch 711 corresponding to each channel 430 of the valve seat 306 can be (e.g. angularly) disposed along a midline of the corresponding channel 430 (e.g. its longitudinal axis can approximately bisect the corresponding channel). In some embodiments, notches 711 can be disposed with a radial arc of approximately 120 degrees therebetween and/or can be spaced around the central channel 432 approximately the same as the channels 430.

As shown in FIG. 7, the channels 430 of valve seat 306 can be approximately evenly spaced (e.g. circumferentially on the second face 440). Typically, all channels 430 in the valve seat can be similar (e.g. in size and shape) and/or all notches 711 in the valve seat can be similar (e.g. in size and shape and location with respect to the corresponding channel). In some embodiments, each channel 430 can have a radial arc length of approximately 60 degrees. In some embodiments, the plurality of channels 430 can comprise three channels that are evenly spaced, for example 120 degrees between midpoints and/or approximately 60 degrees between the radial arcs (e.g. the adjacent ends) of adjacent channels. Typically, the channels 430 can be positioned radially on the valve seat 306 at a distance allowing overlap with the first and/or second flow portion 422*a,b* of the steering valve 304 (e.g. when rotationally oriented for flow through the channels 430) and/or overlap with the blind notch recess 707 (e.g. when oriented with the cut-off portion covering the channel).

In embodiments, the central channel 408 of the steering valve 304 can overlap with the central channel 432 of the valve seat 306 (e.g. at all times and/or all rotational positions). In some embodiments, the central channel 408 of the steering valve 304 can be approximately the same size as the central channel 432 of the valve seat 306. The central channel 432 of the valve seat 306 typically is in fluid communication with an annulus or other low-pressure volume (e.g. the central channel of the valve seat is configured for venting/bleeding off of fluid from deactivated steering pads).

In embodiments, the closed portion 404 of the steering valve 304 can extend angularly more than the cut-off portion 406 and/or the open portion 402. For example, the closed portion 404 may extend with a radial arc of approximately 240 degrees, while the cut-off portion 406 may have a radial arc of approximately 60 degrees. In some embodiments, each flow portion 422 (e.g. gap 340 of the first flow portion 422*a* or the second flow portion 422*b*) can have a radial arc of approximately 30 degrees and/or the total radial arc of all flow portion(s) 422 of the steering valve 304 can be approximately 60 degrees. In some embodiments, the open portion 402 can have a radial arc of approximately 120 degrees. In some embodiments, the first face 435 of the steering valve 304 can be symmetrical about a centerline bisecting the cut-off portion 406 and/or the second face 440 of the valve seat 306 can be symmetrical (e.g. about any centerline).

In some embodiments, the recess 342 and the blind notch recess 707 can have approximately the same depth. In some embodiments, the depth of the blind notch recess 707 can be less than that of the recess 342, while in other embodiments, the depth of the blind notch recess 707 can be greater than that of the recess 342. By way of example, the depth of the recess 342 can be approximately 0.5 inch, and the depth of the blind notch recess 707 can be approximately 0.1 inch.

As discussed in more detail with respect to FIG. 4, in some embodiments, the (e.g. continuous) closed portion 404 can have a first end abutting a second end of the open portion 402, and a third end positioned opposite the first end and abutting a fourth end of the open portion 402. In some embodiments, the open portion 402 can have the second end abutting the first end of the continuous closed portion 404, and the fourth end positioned opposite the third end and abutting the third end of the continuous closed portion 404. In some embodiments, the cut-off portion 406 can be positioned between the second end and the fourth end. In embodiments, the orientation of the continuous closed portion 404 can be adjustable to cover a first subset of the channels 430, while an orientation of the cut-off portion 406 can be adjustable to cover a second subset of the channels 430 (e.g. and jointly the first subset and the second subset would comprise all of the plurality of channels 430 in the valve seat 306).

In some embodiments, the open portion 402 may have the first flow portion 422*a* extending between the second end of the open portion 402 and a fifth end of the cut-off portion 406, and the second flow portion 422*b* extending between a sixth end of the cut-off portion 406 and the fourth end of the open portion 402 (e.g. with the sixth end positioned opposite the fifth end with respect to the cut-off portion 406). In embodiments, the orientation of the cut-off portion 406 can be adjustable to cover a particular channel 430 of the plurality of channels of the valve seat 306 to deactivate a particular steering pad of the plurality of steering pads 348 of the rotary steerable drilling system, with the orientation of the cut-off portion 406 positionable in a particular orientation that causes each steering pad of the rotary steerable drilling system to be deactivated. In embodiments, the closed portion 404 can be configured to adjustably cover one or more of the plurality of the channels 430.

In some embodiments, the closed portion 404 can have a first radius range $r_1$ extending from a center of the steering valve 304 to a first outer surface of the steering valve corresponding to the continuous closed portion 404, and the open portion 406 can have a second radius range $r_2$ extending from the center of the steering valve 304 to a second outer surface of the steering valve corresponding to the open portion 402, with the first radius range $r_1$ being greater than the second radius range $r_2$ (see for example FIG. 9B). In some embodiments, the first radius range $r_1$ may extend radially outward beyond the outer edge of the channels 430 (e.g. $r_1$ can be greater than outer channel distance $d_4$). In some embodiments, the second radius range $r_2$ may extend radially outward less than the outer edge of the channels 430 (e.g. $r_2$ can be less than the outer channel distance $d_4$) and/or approximately to or less than the inner edge of the channels 430 (e.g. $r_2$ can be no more than inner channel distance $d_3$). In some embodiments, the cut-off portion 406 and/or the closed portion 404 may extend radially to the first radius range $r_1$, and the first and second flow portions 422*a,b* may extend radially outward to the second radius range $r_2$. For example, the first radius range $r_1$ can be usable to cover the channels 430 of the valve seat 306 and/or the second radius range $r_2$ can be usable to expose/uncover the channels 430 of the valve seat 306. Typically, both the cut-off portion 406 and the closed portion 404 of the steering valve 304 can extend sufficiently radially outward to completely/effectively cover/close the channels 430, and/or the flow portion(s) 422 may extend less than the outer channel distance $d_4$ so that they can effectively uncover the channels 430). At a specific orientation of the steering valve 304 relative to the valve seat 306, the flow of fluid through the channels 430 can be blocked to all steering pads (e.g. see for example FIG. 12). In embodiments, each of the steering pads can be activated for more than or equal to 120 degrees of rotation of the steering valve 304 relative to the valve seat 306.

Figure 11:
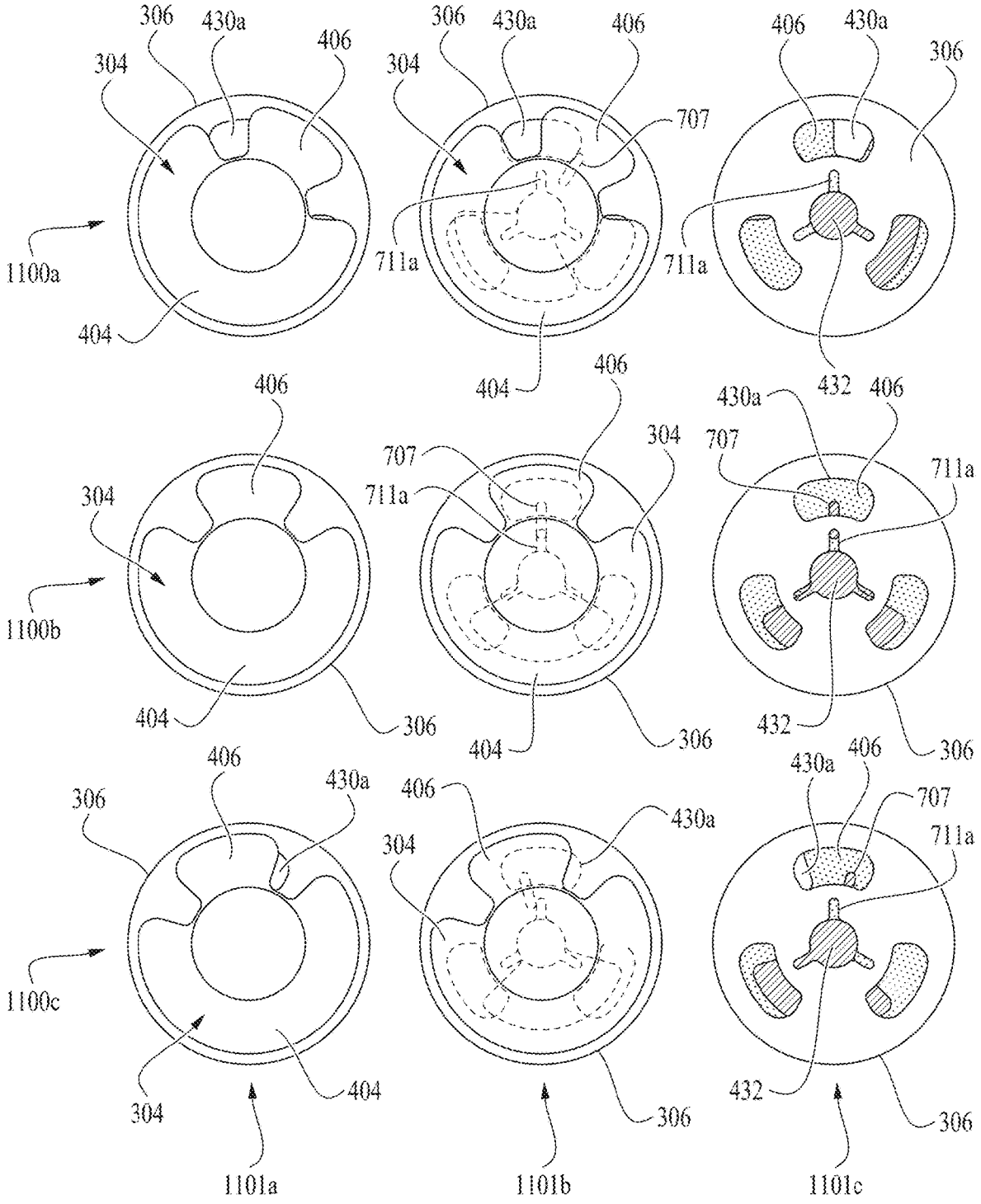
FIG. 11 is a sequence with different views of positions of the steering valve of FIG. 7 with respect to the valve seat according to one example of the present disclosure.

FIG. 11 illustrates the system of FIG. 7 in various orientations, for illustrative purposes. FIG. 11 is a sequence with different views 1101*a-c* of positions 1100 *a-c* of the steering valve 304 with respect to the valve seat 306 according to one example of the present disclosure. As illustrated, FIG. 11 includes the positions 1100*a-c*, which are arranged horizontally as rows, and the different views 1101*a-c*, which are arranged vertically as columns. For example, portions of FIG. 11 in a common row (e.g., corresponding to the position 1100*a*, etc.) involve different views of a similar position, and portions of FIG. 11 in a common column (e.g., corresponding to one or more views included in the views 1101*a*, etc.) involve a similar view of different positions. Additionally, while FIG. 11 is illustrated with respect to the channel 430*a*, similar positions and views are possible for other channels, such as the channels 430*b-c*, etc., of the valve seat 306.

As illustrated, the position 1100*a* involves the steering valve 304 positioned on the valve seat 306 such that the cut-off portion 406 of the steering valve 304 is partially covering the channel 430*a* of the valve seat 306. The views 1101*a* include a top-view of the position 1100*a*, the views 1101*b* include a transparent top-view of the position 1100*a*, and the views 1101*c* include a bottom-view of the position 1100*a*. In the position 1100*a*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430 *b-c* to be deactivated.

In the position of 1100*a*, no bleed-off is needed for channel 430*a*, since it is receiving activation fluid to actuate its corresponding steering pad. In fact, activation works best if there is no other path for the fluid (e.g. so that the pressure from the fluid entering through channel 430*a* all acts on the steering pad). Thus, the blind notch recess 707 does not overlap the corresponding notch 711*a* in position 1100*a*, and there is no fluid communication between the steering pad corresponding to channel 430*a* and the central channel 432. In position 1100*a*, the remaining channels 430*b,c* are covered, and bleed-off of fluid from the corresponding steering pads can occur due to overlap of the remaining channels 430 with the recess of the steering valve 304.

The position 1100*b* may involve the cut-off portion 406 completely covering the channel 430*a* of the valve seat 306 (e.g. and all channels 430 of the valve seat 306 being completely covered, so that none of the steering pads are activated). The views 1101*a* include a top-view of the position 1100*b*, the views 1101*b* include a transparent top-view of the position 1100*b*, and the views 1101*c* include a bottom-view of the position 1100*b*. The steering valve 304 can be rotated, for example from the position 1100*a* to the position 1100*b*. The cut-off portion 406, in the position 1100*b*, may prevent fluid from flowing through the channel 430*a*. Accordingly, the cut-off portion 406 in the position 1100*b* may deactivate a steering pad of the rotary steerable system 109 that corresponds to the channel 430*a*. In some examples, the closed portion 404 of the steering valve 304 in the position 1100*b* may cover the remaining channels 430*b-c* of the valve seat 306. Thus, by positioning the cut-off portion 406 to prevent flow of fluid to the channel 430*a*, the steering valve 304 can deactivate each of the steering pads included in the rotary steerable system 109.

In the position 1100*b*, bleed-off is needed for channel 430*a* in order to effectively deactivate its corresponding steering pad. Without effectively bleed-off, the steering pad corresponding to channel 430*a* would still be pressurized, even if no new fluid flow enters through the channel 430*a* (e.g. since there would be captured fluid). Thus, the blind notch recess 707 overlaps the corresponding notch 711*a* in position 1100*a*, and there is fluid communication between the steering pad corresponding to channel 430*a* and the central channel 432 (allowing bleed-off of pressurized fluid).

In position 1100*b*, the remaining channels 430*b,c* are covered, and bleed-off of fluid from the corresponding steering pads can occur due to overlap of the remaining channels 430*b,c* with the recess of the steering valve 304.

As illustrated, the position 1100*c* involves the steering valve 304 positioned on the valve seat 306 such that the cut-off portion 406 of the steering valve 304 is partially covering the channel 430*a* (e.g., a different side of the channel 430*a* compared to the position 1100*a*) of the valve seat 306. The views 1101*a* include a top-view of the position 1100*c*, the views 1101*b* include a transparent top-view of the position 1100*c*, and the views 1101*c* include a bottom-view of the position 1100*c*. In the position 1100*c*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430*b-c* to be deactivated.

In the position of 1100*c*, no bleed-off is needed for channel 430*a*, since it is receiving activation fluid to actuate its corresponding steering pad. In fact, activation works best if there is no other path for the fluid (e.g. so that the pressure from the fluid entering through channel 430*a* all acts on the steering pad). Thus, the blind notch recess 707 does not overlap the corresponding notch 711*a* in position 1100*c*, and there is no fluid communication between the steering pad corresponding to channel 430*a* and the central channel 432. In position 1100*c*, the remaining channels 430*b,c* are covered, and bleed-off of fluid from the corresponding steering pads can occur due to overlap of the remaining channels 430*b,c* with the recess of the steering valve 304.

Figure 13A:
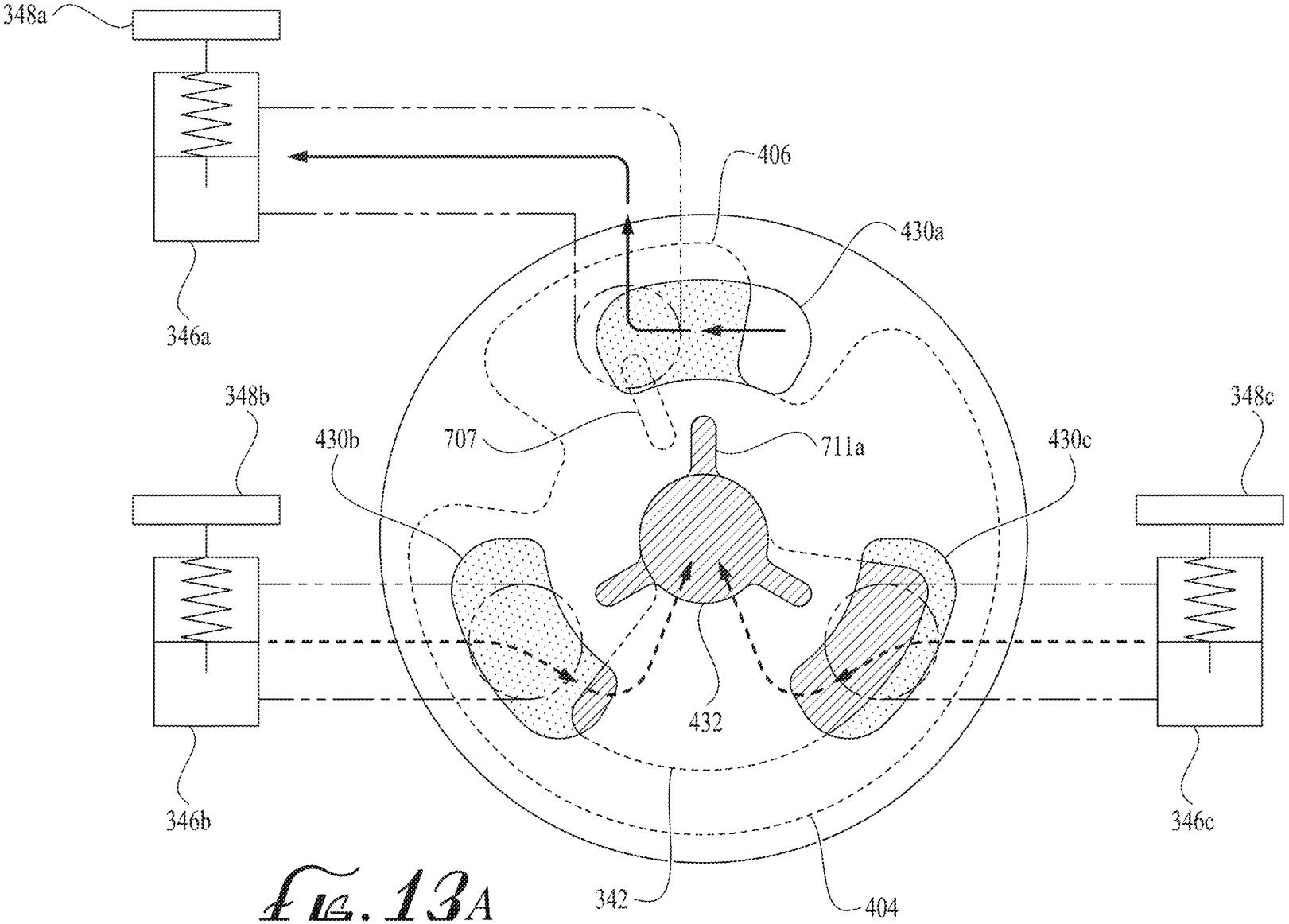
FIGS. 13A-B schematically illustrate fluid flow and bleed-off for orientations of the steering valve operable to activate one or more steering pad according to one example of the present disclosure.
Figure 13B:
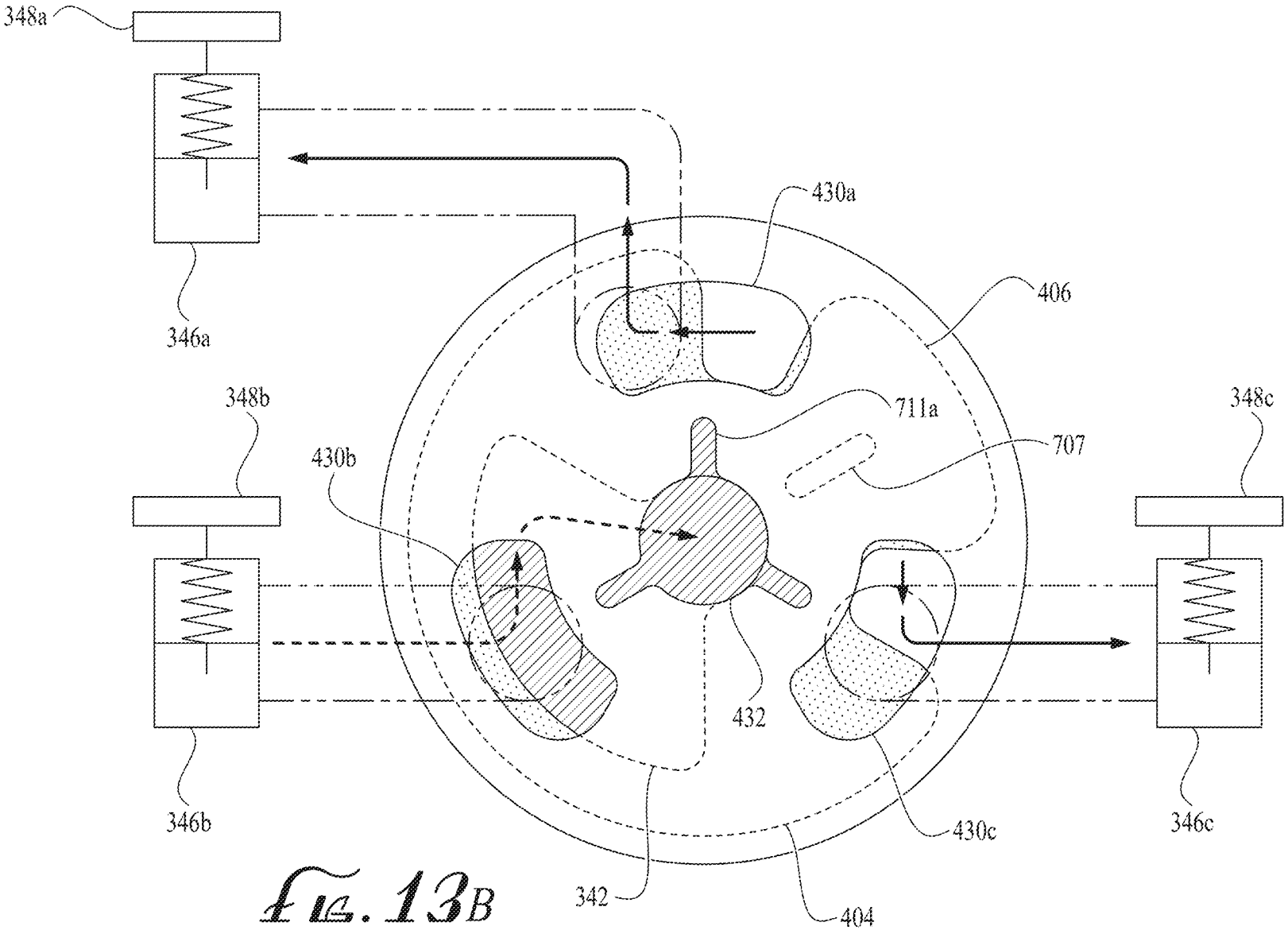

FIG. 13A illustrates an orientation of the steering valve 304 relative to the valve seat 306 in which one channel 430*a* is uncovered and/or one steering pad receives activation fluid, and the remaining channels 430*b,c* are covered and/or the fluid pressure in the remaining steering pads is bled-off. In this orientation, one steering pad is activated, while two steering pads are deactivated. FIG. 13B illustrates an orientation of the steering valve 304 relative to the valve seat 306 in which two channels 430*a,c* are uncovered and/or two steering pads received activation fluid, and the remaining channel 430*b* is covered and/or the fluid pressure in the remaining steering pad is bled-off. In this orientation, two steering pads are activated, while one steering pad is deactivated. In both FIGS. 13A-B, the specific steering pads which are activated or deactivated can vary depending on which channels 430 are covered and uncovered, as persons of skill will appreciate.

Figure 14:
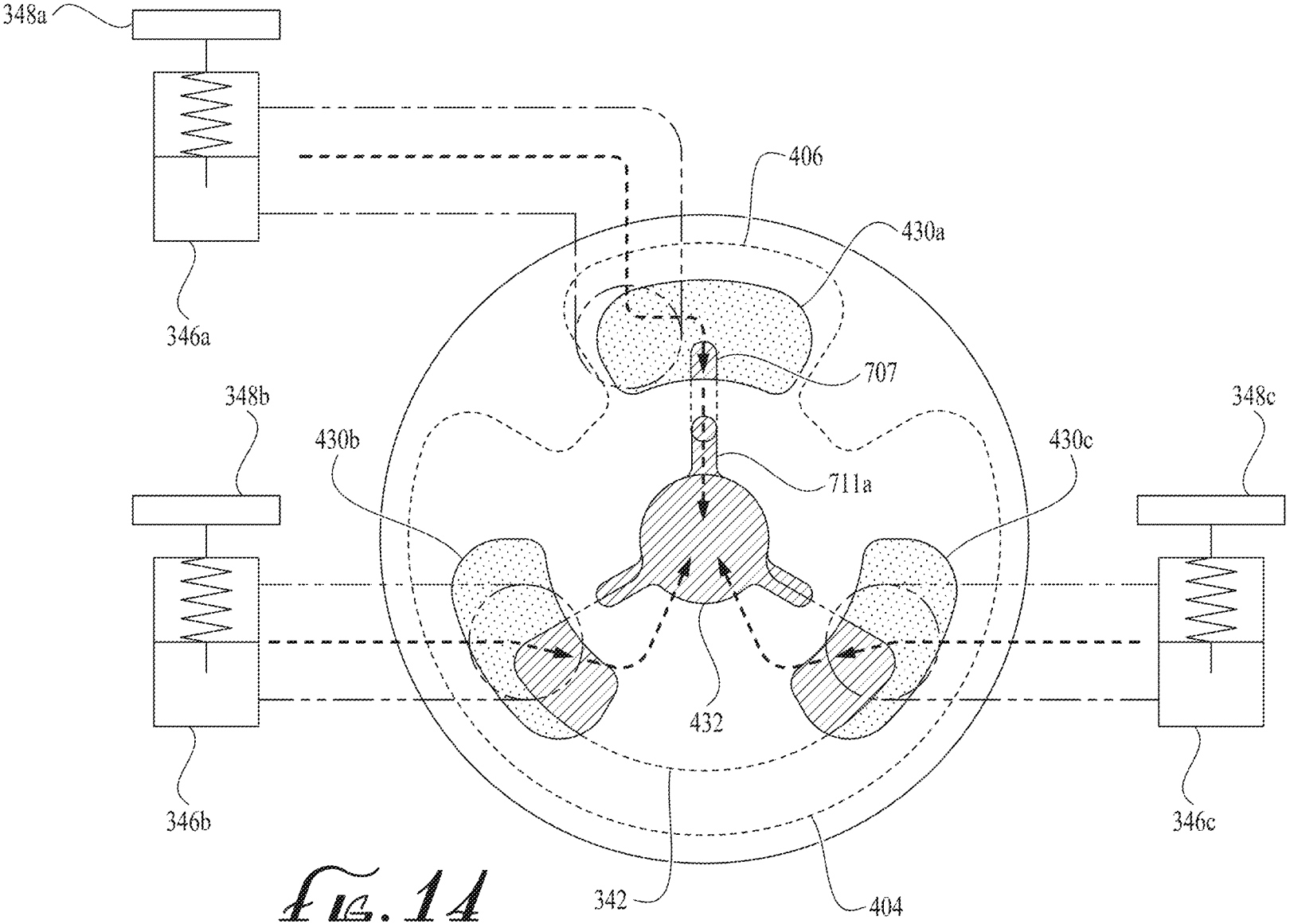
FIG. 14 schematically illustrates bleed-off when the steering valve deactivates all steering pads (e.g. by covering all channels of the valve seat) according to one example of the present disclosure.

FIG. 14 illustrates an orientation of the steering valve 304 relative to the valve seat 306 in which all of the channels 430 are covered, illustrating the bleed-off flow from all of the steering pads to the central channel 432 of the valve seat 306. In this embodiment, one of the steering pads (e.g. the steering pad in fluid communication with the channel 430*a* which is covered by the cut-off portion 406) bleeds-off via the blind notch recess 707 and overlapping notch 711*a*, while two of the steering pads (e.g. the steering pads in fluid communication with the channels 430*b,c* covered by the closed portion 404 and/or not covered by the cut-off portion) bleed-off via overlapping of the corresponding channels 430*b,c* with the recess 342 (e.g. since the recess is in fluid communication with the central channel 432 of the valve seat 306). Thus, when all of the channels 430 of the valve seat 306 are covered in FIG. 14, all of the steering pads are in fluid communication with the central channel 432 of the valve seat 306 and bleed-off fluid pressure thereto.

While exemplary descriptions may discuss embodiments having three channels 430, with each channel corresponding to a specific steering pad, persons of skill will understand that other embodiments, for example having a different number of channels 430 and/or having more than one steering pad corresponding to one or more channel 430, are also included within the scope of this disclosure. System embodiments are not limited to the embodiments of the figures, which are merely illustrative, but extend at least to the full extent of the claims and the equivalents.

Also disclosed are exemplary methods of operating a rotary steerable drilling system and/or controlling steering pads of the rotary steerable drilling system (for example using a system similar to one of the disclosed embodiments, such as the embodiment of FIG. 7). For example, a method (e.g. of operating a rotary steerable drilling system and/or controlling steering pads of the rotary steerable drilling system) can comprise positioning the rotary steerable drilling system in a subterranean formation to steer a drill string to form a wellbore in the subterranean formation, and adjusting an orientation of the steering valve of the rotary steerable drilling system to cover all of the channels of the valve seat to prevent flow of (e.g. activation) fluid through the channels and deactivate all of the steering pads of the rotary steerable drilling system.

Typically, when the orientation of the steering valve covers all channels of the valve seat, the blind notch recess of the steering valve can be aligned with and/or overlap with one of the notches of the valve seat, and adjusting an orientation of the steering valve can comprise bleeding fluid pressure from the steering pad corresponding to (e.g. in fluid communication with) the aligned and/or overlapping notch (e.g. to deactivate (e.g. retract) this steering pad). For example, bleeding fluid pressure from the steering pad corresponding to the aligned and/or overlapping notch (e.g. typically the channel covered by the cut-off portion) can comprise placing that steering pad in fluid communication with the blind notch recess, the aligned and overlapping notch, the recess of the steering valve, and/or the central channel of the valve seat. For convenience, FIG. 14 illustrates an exemplary fluid pressure bleed-off pathway.

As also shown in FIG. 14, the remaining channels of the valve seat (e.g. other than the channel corresponding to the aligned and/or overlapping notch, for example the channels covered by the closed portion) can overlap with the recess in the steering valve, such that adjusting an orientation of the steering valve can comprise bleeding fluid pressure from the steering pads corresponding to (e.g. in fluid communication with) these remaining channels (e.g. to deactivate (e.g. retract) these steering pads). For example, bleeding fluid pressure from the steering pads corresponding to (e.g. in fluid communication with) these remaining channels can comprise placing these steering pads in fluid communication with the recess of the steering valve and/or the central channel of the valve seat. In some embodiments, adjusting an orientation of the steering valve can comprise covering one of the channels with the cut-off portion of the steering valve and covering the remaining channels (e.g. other than the channel covered by the cut-off portion) with the closed portion of the steering valve (e.g. thereby jointly preventing fluid flow to all steering pads).

Exemplary method embodiments can further comprise adjusting the orientation of the steering valve to activate (e.g. radially extend) at least one of the steering pads. Activation of a steering pad can occur when the corresponding channel is uncovered (e.g. allowing activation fluid flow therethrough). Typically, the blind notch recess of the steering valve does not align with any of the notches of the valve seat when one or more of the steering pads is being activated (e.g. when one or more of the channels is uncovered). For example, activating a steering pad may comprise preventing fluid communication of the blind notch and/or notches with one or more channel (e.g. with all channels). Preventing fluid communication of the blind notch and/or notches with one or more channel may comprise rotating the steering valve with respect to the valve seat (e.g. so that the blind notch recess does not align with any of the notches of the valve seat).

In an example, the valve seat may have three channels, and the closed portion of the steering valve can cover (e.g. overlaps entirely with and prevents fluid flow therethrough) one or two of the three channels, for example to deactivate (e.g. retract) the steering pads correspond to those covered channels. In this orientation, the closed portion does not cover one or two of the three channels, for example allowing activation of those uncovered channels (e.g. depending on the specific rotational orientation of the steering valve). Instead, the first and/or second flow portion of the steering valve can overlap with one or two of the three channels (e.g. providing fluid flow therethrough to the corresponding steering pad(s), to activate those steering pads). For convenience, FIGS. 13A-B illustrate such orientations.

In embodiments, adjusting the orientation of the steering valve to activate at least one of the steering pads can comprise uncovering the channel corresponding to (e.g. in fluid communication with) the at least one activated steering pad and flowing fluid therethrough to the at least one activated steering pad. In some embodiments, adjusting the orientation of the steering valve to activate at least one of the steering pads can further comprise covering the channels corresponding to (e.g. in fluid communication with) the other/remaining steering pads (e.g. the steering pads other than the at least one activated steering pad) and/or bleeding fluid pressure from the other/remaining steering pads. In embodiments, bleeding fluid pressure from the other/remaining steering pads can comprise placing each of the other/remaining steering pads in fluid communication with the corresponding channel, the recess of the steering valve, and/or the central channel of the valve seat.

In some embodiments, the notches and/or blind notch recess can be sized so that any leakage (e.g. of activation fluid) therethrough, for example during rotation of the valve from one orientation to another, has no substantial or significant impact on performance of the rotary steerable drilling system. In some embodiments, this can be described in terms of a percentage of time during which leakage through the notch occurs compared to the time the pad is activated (e.g. with a relatively low percentage of leakage time versus pad activation time providing effective steering force). For example, the notches can be sized such that the time when leakage through the notch happens is no more than approximately 10% of the time the specific pad is activated (for example approximately 1-10%, approximately 3-10%, approximately 5-10%, or approximately 8-10%). In some embodiments, the notches and/or blind notch recess can be sized so that fluid flow therethrough associated with a deactivated steering pad (e.g. the fluid pressure of the steering pad covered by the cut-off portion when all channels are covered) effectively bleeds fluid pressure from that steering pad. For example, the minimum flow cross-sectional area in some embodiments can be approximately 0.001 $in^2$ and/or an associated flow path can have a minimum diameter of approximately 1 mm.

By providing pressure relief, disclosed embodiments may reduce or eliminate pressure spikes in the system. In embodiments, this may reduce seal stress and/or valve chattering. Disclosed embodiments can improve reliability and service life. Such improvements can improve the overall drilling system, which can reduce costs and/or increase profitability, for example associated with a hydrocarbon well. Persons of skill will understand these and other potential benefits of disclosed embodiments.

ADDITIONAL DISCLOSURE

The following are non-limiting, specific embodiments in accordance with the present disclosure:

In a first embodiment, a system (e.g. for controlling steering pads of a rotary steerable drilling system) can comprise: a valve seat (e.g. positionable within the rotary steerable drilling system) comprising a central channel therethrough and a plurality of (e.g. activation) channels therethrough, wherein each of the plurality of (e.g. activation) channels corresponds to (e.g. is in fluid communication with) one of the steering pads (e.g. fluid flow through the channels can control activation/deactivation (e.g. radial extension) of the steering pads during operation of the rotary steering drilling system); and a steering valve (e.g. positionable within the rotary steerable drilling system) comprising a closed portion and an open portion (e.g. circumferentially adjacent and/or abutting), wherein the open portion comprises a cut-off-portion and at least one flow portion (e.g. typically a first flow portion and a second flow portion, for example with the cut-off portion disposed between the first and second flow portions); wherein: the steering valve is disposed adjacent to the valve seat (e.g. with a first face of the steering valve adjacent to, in proximity to, abutting, and/or facing a second face of the valve seat) and is configured to rotate relative to the valve seat (e.g. to control flow of fluid through the plurality of channels of the valve seat, for example based on whether and the amount that the steering valve blocks/covers one or more of the plurality of channels in the valve seat); the steering valve comprises a recess (e.g. disposed in the closed portion, which can include a central channel—typically the recess can be disposed in (e.g. sunken in) the first face of the steering valve, which can be oriented towards the valve seat); the steering valve comprises a blind notch recess (e.g. disposed in the open portion and/or extending radially in the cut-off portion—typically the blind notch recess is also disposed in (e.g. sunken in) the first face of the steering valve (e.g. the blind notch recess and the recess are disposed in the same face of the steering valve and face the valve seat but are not connected—for example they can be separated by a portion of the steering valve body, with the blind notch recess radially outward of the recess)); for each of the plurality of channels, the valve seat comprises a notch (extending through the valve seat) extending radially outward from the central channel (e.g. the notch can be open to the central channel and can extend towards but not intersect the corresponding (e.g. activation) channel—for example they can be separated by a portion of the valve seat); the blind notch recess comprises an inner end (e.g. radial) distance (e.g.

disposed radially outward of the recess—e.g. not connected, but separated by a portion of the valve body) and an outer end (e.g. radial) distance, wherein the outer end (radial) distance is radially outward of the inner end (radial) distance; the outer end distance extends radially outward sufficiently to allow for interaction/overlap with the plurality of channels in the valve seat when properly (e.g. rotationally) oriented (e.g. extends radially outward beyond an inner channel distance); and/or each notch extends radially outward beyond the inner end distance (but does not extend to the inner channel distance). In some embodiments, the notch and/or the central channel of the valve seat can also overlap with the recess in the steering valve based on orientation of the steering valve.

A second embodiment can include the system of the first embodiment, wherein the first flow portion and the second flow portion are each configured to allow passage of fluid therethrough (e.g. each comprise a gap).

A third embodiment can include the system of the first or second embodiments, wherein the steering valve is configured to be oriented/positioned with respect to the valve seat to control activation/deactivation of the steering pads, and wherein the orientation can allow for one pad to be active (e.g. radially extended) while two pads are inactive (e.g. radially retracted), two pads to be active (e.g. radially extended) while one pad is inactive (e.g. radially retracted), or all pads to be inactive (e.g. radially retracted) (e.g. and wherein which specific pads are active and inactive can be changed based on orientation of the steering valve with respect to the valve seat).

A fourth embodiment can include the system of any one of the first to third embodiments, wherein when the steering valve is rotationally positioned relative to the valve seat to close/cover/block all of the plurality of channels (e.g. wherein the steering valve is configured so that, responsive to the steering valve being rotationally positioned relative to the valve seat to close all channels), one of the notches of the valve seat overlaps with the blind notch recess of the steering valve (e.g. the specific notch extending towards the channel that is closed/covered by the cut-off portion overlaps with the blind notch recess).

A fifth embodiment can include the system of any one of the first to fourth embodiments, wherein the system is configured to bleed off fluid pressure from the steering pad which is closed/covered by the cut-off portion when the blind notch recess is aligned with and/or overlaps the notch corresponding to that steering pad (e.g. typically only when the valve is positioned to close all of the plurality of channels in the valve seat). For example, fluid pressure from the steering pad corresponding to the channel covered by the cut-off portion can be bled off through the overlapping blind notch recess and notch.

A sixth embodiment can include the system of any one of the first to fifth embodiments, wherein the central channel of the valve seat is configured to be in fluid communication with one or more of the steering pads based on orientation of the steering valve with respect to the valve seat (e.g. when the steering valve is positioned/oriented relative to the valve seat to close channels leading to the one or more steering pads) (e.g. thereby deactivating the corresponding steering pads) (e.g. when one or more steering pad is deactivated and/or no longer receives activating fluid flow, that one or more steering pad is in fluid communication with the central channel of the valve seat (e.g. for fluid pressure bleed off)).

A seventh embodiment can include the system of any one of the first to sixth embodiments, wherein, when the steering valve closes/covers all of the channels and/or blocks fluid flow to all of the steering pads, fluid pressure of one of the steering pads (e.g. the pad corresponding to the channel being covered by the cut-off portion) bleeds off through the blind notch recess and the (e.g. overlapping) corresponding notch in the valve seat to the recess, and from the recess through the central channel of the valve seat. In embodiments, fluid pressure is only bled off in this manner when all of the channels are covered by the steering valve.

An eighth embodiment can include the system of the seventh embodiment, wherein the fluid pressure of the remaining steering pads (e.g. the steering pads other than that corresponding to the channel being covered by the cut-off portion and/or the steering pads corresponding to the channels covered by the closed portion of the steering valve) bleeds off due to overlap of the corresponding channels with the recess in the steering valve (e.g. a portion of each such channel overlaps with and/or is in fluid communication with a portion of the recess, which is in turn in fluid communication with the central channel of the valve seat).

A ninth embodiment can include the system of any one of the first to eighth embodiments, wherein the recess in the steering valve is (e.g. circumferentially) larger at its distal/radial outward end (e.g. the recess flares outward as it extends radially from the central channel of the steering valve and/or away from the open portion).

A tenth embodiment can include the system of any one of the first to ninth embodiments, wherein the blind notch recess overlaps with one of the notches of the valve seat when the steering valve is positioned to close all channels.

An eleventh embodiment can include the system of the tenth embodiment, wherein the amount of overlap of the notch with the blind notch recess is approximately equal to the width of the blind notch recess and/or the notch (e.g. the notch and blind notch recess may have approximately the same width, and the radial overlap may be approximately the same amount/diameter as that width and/or may be no less than that width).

A twelfth embodiment can include the system of any one of the first to eleventh embodiments, wherein the notch corresponding to each channel of the valve seat can be (e.g. angularly) disposed along a midline of the corresponding channel (e.g. its longitudinal axis can approximately bisect the corresponding channel) (e.g. notches are disposed with a radial arc of approximately 120 degrees therebetween) (e.g. notches are spaced around the central channel approximately the same as the channels).

A thirteenth embodiment can include the system of any one of the first to twelfth embodiments, wherein the channels of valve seat are approximately evenly spaced (e.g. circumferentially on the first face).

A fourteenth embodiment can include the system of any one of the first to thirteenth embodiments, wherein all channels in the valve seat are similar (e.g. in size and shape) and all notches in the valve seat are similar (e.g. in size and shape and location with respect to the corresponding channel).

A fifteenth embodiment can include the system of any one of the first to fourteenth embodiments, wherein the channels are positioned radially on the valve seat at a distance allowing overlap with the first and/or second flow portion of the steering valve (e.g. when rotationally oriented for flow through the channels).

A sixteenth embodiment can include the system of any one of the first to fifteenth embodiments, wherein the central channel of the steering valve overlaps with the central channel of the valve seat (e.g. at all times and/or all rotational positions).

A seventeenth embodiment can include the system of any one of the first to sixteenth embodiments, wherein the central channel of the valve seat is in fluid communication with an annulus or other low-pressure volume (e.g. the central channel of the valve seat is configured for venting/bleeding off of fluid from deactivated steering pads).

An eighteenth embodiment can include the system of any one of the first to seventeenth embodiments, wherein the steering valve can be configured with a generally circular shape, with the closed portion comprising an unbroken/continuous portion of the circular shape and the open portion comprising a broken portion of the circular shape (e.g. with the open portion having one or more gap (e.g. flow portion) and the cut-off portion (which can be disposed between the flow portions in some embodiments) forming another portion of the circular shape.

A nineteenth embodiment can include the system of any one of the first to eighteenth embodiments, wherein the first face of the steering valve is symmetrical about a centerline bisecting the cut-off portion; and/or wherein the second face of the valve seat is symmetrical (e.g. about any centerline).

A twentieth embodiment can include the system of any one of the first to nineteenth embodiments, wherein the open portion of the steering valve is configured to allow fluid flow to one or more of the steering pads via the corresponding channels (e.g. based on the rotational position/orientation of the open portion with respect to the valve seat); and/or wherein the closed portion of the steering valve comprises a continuous portion (e.g. is continuous and/or unbroken, for example configured without fluid passage therethrough), wherein the closed position is configured to adjustably cover (e.g. based on its rotational position/orientation with respect to the valve seat) and thereby close one or more of the channels of the valve seat (e.g. to prevent flow of fluid through the channel(s) and thereby deactivate the corresponding steering pad(s)) (e.g. an orientation of the continuous closed portion is adjustable to cover each of the plurality of channels of the valve seat to both prevent a flow of fluid through each channel of the plurality of channels of the valve seat and deactivate each of the plurality of steering pads of the rotary steerable system).

A twenty-first embodiment can include the system of any one of the first to twentieth embodiments, wherein: the continuous closed portion comprises: a first end abutting a second end of the open portion; a third end positioned opposite the first end and abutting a fourth end of the open portion; and the open portion comprises: the second end abutting the first end of the continuous closed portion; and the fourth end positioned opposite the third end and abutting the third end of the continuous closed portion; wherein the cut-off portion is positioned between the second end and the fourth end (e.g. the cut-off portion positionable to cover at least one channel of the one or more channels of the valve seat to deactivate at least one steering pad of a rotary steerable drilling system).

A twenty-second embodiment can include the system of the twenty-first embodiment, wherein the open portion comprises: the first flow portion extending between the second end of the open portion and a fifth end of the cut-off portion; and the second flow portion extending between a sixth end of the cut-off portion and the fourth end of the open portion, wherein the sixth end is positioned opposite the fifth end with respect to the cut-off portion.

A twenty-third embodiment can include the system of any one of the first to twenty-second embodiments, wherein the orientation of the cut-off portion is adjustable to cover a particular channel of the plurality of channels of the valve seat to deactivate a particular steering pad of the plurality of steering pads of the rotary steerable drilling system, wherein the orientation of the cut-off portion is positionable in a particular orientation that causes each steering pad of the rotary steerable drilling system to be deactivated.

A twenty-fourth embodiment can include the system of any one of the first to twenty-third embodiments, wherein: the closed portion further comprises a first radius range extending from a center of the steering valve to a first outer surface of the steering valve corresponding to the continuous closed portion; and the open portion further comprises a second radius range extending from the center of the steering valve to a second outer surface of the steering valve corresponding to the open portion, wherein the first radius range is greater than the second radius range, and wherein the first radius range is usable to cover the channels of the valve seat and/or the second radius range is usable to expose/uncover the channels of the valve seat.

In a twenty-fifth embodiment, a method (e.g. of operating a rotary steerable drilling system and/or controlling steering pads of the rotary steerable drilling system) can comprise: positioning the rotary steerable drilling system of any one of the first to twenty-fourth embodiments in a subterranean formation to steer a drill string to form a wellbore in the subterranean formation; and adjusting an orientation of the steering valve of the rotary steerable drilling system to cover all of the channels of the valve seat to prevent flow of (e.g. activation) fluid through the channels and deactivate all of the steering pads of the rotary steerable drilling system.

A twenty-sixth embodiment can include the method of the twenty-fifth embodiment, wherein the blind notch recess of the steering valve is aligned with and overlaps with one of the notches of the valve seat, the wherein adjusting an orientation of the steering valve comprises bleeding fluid pressure from the steering pad corresponding to (e.g. in fluid communication with) the aligned and overlapping notch (e.g. to deactivate (e.g. retract) this steering pad).

A twenty-seventh embodiment can include the method of the twenty-sixth embodiment, wherein bleeding fluid pressure from the steering pad corresponding to the aligned and overlapping notch comprises placing that steering pad in fluid communication with the blind notch recess, the aligned and overlapping notch, the recess of the steering valve, and/or the central channel of the valve seat.

A twenty-eighth embodiment can include the method of any one of the twenty-sixth to twenty-seventh embodiments, wherein the (e.g. remaining) channels of the valve seat other than the channel corresponding to the aligned and overlapping notch overlap with the recess in the steering valve, and wherein adjusting an orientation of the steering valve comprises bleeding fluid pressure from the steering pads corresponding to (e.g. in fluid communication with) these channels (e.g. to deactivate (e.g. retract) these steering pads).

A twenty-ninth embodiment can include the method of the twenty-eighth embodiment, wherein bleeding fluid pressure from the steering pads corresponding to (e.g. in fluid communication with) these channels comprises placing these steering pads in fluid communication with the recess of the steering valve and/or the central channel of the valve seat.

A thirtieth embodiment can include the method of any one of the twenty-fifth to twenty-ninth embodiments, wherein adjusting an orientation of the steering valve comprises covering one of the channels with the cut-off portion of the steering valve and covering the remaining channels (e.g. other than the channel covered by the cut-off portion) with the closed portion of the steering valve (e.g. thereby preventing fluid flow to all steering pads).

A thirty-first embodiment can include the method of any one of the twenty-fifth to thirtieth embodiments, further comprising adjusting the orientation of the steering valve to activate (e.g. radially extend) at least one of the steering pads, wherein the blind notch recess of the steering valve does not align with any of the notches of the valve seat.

A thirty-second embodiment can include the method of the thirty-first embodiment, wherein the plurality of channels of the valve seat comprises three channels, and the closed portion of the steering valve covers (e.g. overlaps entirely with and prevents fluid flow therethrough) one or two of the three channels, for example to deactivate (e.g. retract) the steering pads correspond to those covered channels (but does not cover one or two of the three channels, for example allowing activation of those uncovered channels).

A thirty-third embodiment can include the method of the thirty-second embodiment, wherein the first and/or second flow portion of the steering valve overlaps with one or two of the three channels (e.g. providing fluid flow therethrough to the corresponding steering pad(s), to activate those steering pads).

A thirty-fourth embodiment can include the method of any one of the thirty-first to thirty-third embodiments, wherein adjusting the orientation of the steering valve to activate at least one of the steering pads comprises uncovering the channel corresponding to (e.g. in fluid communication with) the at least one activated steering pad and flowing fluid therethrough to the at least one activated steering pad.

A thirty-fifth embodiment can include the method of the thirty-fourth embodiment, wherein adjusting the orientation of the steering valve to activate at least one of the steering pads further comprises covering the channels corresponding to (e.g. in fluid communication with) the other/remaining steering pads (e.g. the steering pads other than the at least one activated steering pad) and/or bleeding fluid pressure from the other/remaining steering pads.

A thirty-sixth embodiment can include the method of the thirty-fifth embodiment, wherein bleeding fluid pressure from the other/remaining steering pads comprises placing each of the other/remaining steering pads in fluid communication with the corresponding channel, the recess of the steering valve, and/or the central channel of the valve seat.

A thirty-seventh embodiment can include the method of any one of the twenty-fifth to thirty-sixth embodiments, wherein responsive to one or more of the plurality of channels being covered and/or one or more of the steering pads being deactivated, fluid pressure is bled from the deactivated/corresponding steering pad(s) through the central channel of the valve seat (e.g. thereby to an annulus or other low-pressure volume).

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for controlling steering pads of a rotary steerable drilling system comprises:

a valve seat comprising a central channel therethrough and a plurality of channels therethrough, wherein each of the plurality of channels corresponds to one of the steering pads, with fluid flow through the channels controlling activation of the steering pads; and a steering valve comprising a closed portion and an open portion, wherein the open portion comprises a cut-off-portion and at least one flow portion;

wherein:

the steering valve is disposed adjacent to the valve seat, with a first face of the steering valve adjacent to a second face of the valve seat, and is configured to rotate relative to the valve seat to control flow of fluid through the plurality of channels of the valve seat;

the steering valve comprises a recess disposed in the closed portion;

the steering valve comprises a blind notch recess extending radially in the cut-off portion, wherein the blind notch recess and the recess are not connected;

for each of the plurality of channels, the valve seat comprises a notch extending radially outward from the central channel, wherein each notch extends towards but does not intersect the corresponding channel; and the steering valve is configured so that, responsive to the steering valve being oriented relative to the valve seat to cover all of the plurality of channels, one of the notches of the valve seat overlaps with the blind notch recess of the steering valve.

2. The system of claim 1, wherein:

the blind notch recess comprises an inner end distance and an outer end distance, wherein the outer end distance is radially outward of the inner end distance;

the outer end distance extends radially outward sufficiently to allow for overlap with the plurality of channels in the valve seat when properly oriented; and each notch extends radially outward beyond the inner end distance.

3. The system of claim 1, wherein the steering valve is configured to be rotationally oriented with respect to the valve seat to control activation of the steering pads, and wherein the orientation can allow for one pad to be active while two pads are inactive, two pads to be active while one pad is inactive, or all pads to be inactive.

4. The system of claim 1, wherein overlap of one of the notches of the valve seat with the blind notch recess is configured to bleed off fluid pressure from the steering pad corresponding to the channel covered by the cut-off portion.

5. The system of claim 1, wherein responsive to one or more steering pad being deactivated, the one or more deactivated steering pad is in fluid communication with the central channel of the valve seat.

6. The system of claim 1, wherein:

the channels of the valve seat are approximately evenly spaced;

all of the plurality of channels in the valve seat are similar, and all notches in the valve seat are similar;

each channel is positioned radially on the valve seat at a distance allowing overlap with the at least one flow portion of the steering valve; and a central channel of the steering valve overlaps with the central channel of the valve seat.

7. The system of claim 1, wherein the at least one flow portion of the steering valve comprises a first flow portion and a second flow portion, wherein the cut-off portion is disposed between the first flow portion and the second flow portion.

8. The system of claim 7, wherein:

the closed portion comprises:

a first end abutting a second end of the open portion; and a third end positioned opposite the first end and abutting a fourth end of the open portion; and the open portion comprises:

the second end abutting the first end of the closed portion; and the fourth end positioned opposite the third end and abutting the third end of the closed portion;

wherein the cut-off portion is positioned between the second end and the fourth end; and wherein the open portion comprises: the first flow portion extending between the second end of the open portion and a fifth end of the cut-off portion; and the second flow portion extending between a sixth end of the cut-off portion and the fourth end of the open portion, wherein the sixth end is positioned opposite the fifth end with respect to the cut-off portion.

9. A method of operating a rotary steerable drilling system comprises:

positioning the rotary steerable drilling system of claim 1 in a subterranean formation to steer a drill string to form a wellbore in the subterranean formation; and adjusting an orientation of the steering valve of the rotary steerable drilling system to cover all of the channels of the valve seat to prevent flow of fluid through the channels and deactivate all of the steering pads of the rotary steerable drilling system.

10. The method of claim 9, wherein the blind notch recess of the steering valve overlaps with one of the notches of the valve seat, and wherein adjusting an orientation of the steering valve comprises bleeding fluid pressure from the steering pad corresponding to the overlapping notch.

11. The method of claim 10, wherein bleeding fluid pressure from the steering pad corresponding to the overlapping notch comprises placing the steering pad corresponding to the overlapping notch in fluid communication with the blind notch recess, the overlapping notch, and the central channel of the valve seat.

12. The method of claim 10, wherein the channels of the valve seat other than the channel corresponding to the overlapping notch overlap with the recess in the steering valve, and wherein adjusting an orientation of the steering valve comprises bleeding fluid pressure from the steering pads corresponding to the other channels.

13. The method of claim 12, wherein bleeding fluid pressure from the steering pads corresponding to the other channels comprises placing the corresponding steering pads in fluid communication with the recess of the steering valve and the central channel of the valve seat.

14. The method of claim 10, wherein adjusting an orientation of the steering valve comprises covering one of the channels with the cut-off portion of the steering valve and covering the remaining channels with the closed portion of the steering valve; and wherein fluid pressure is bled from the steering pad corresponding to the channel covered by the cut-off portion through the blind notch recess and the overlapping notch.

15. The method of claim 9, further comprising adjusting the orientation of the steering valve to activate at least one of the steering pads, wherein the blind notch recess of the steering valve does not align with any of the notches of the valve seat.

16. The method of claim 15, wherein:

the plurality of channels of the valve seat comprises three channels;

the closed portion of the steering valve covers one or two of the three channels; and the at least one flow portion of the steering valve overlaps with one or two of the three channels.

17. The method of claim 15, wherein adjusting the orientation of the steering valve to activate at least one of the steering pads comprises uncovering the channel corresponding to the at least one activated steering pad and flowing fluid therethrough to the at least one activated steering pad; and bleeding fluid pressure from the steering pads other than the at least one activated steering pad.

18. The method of claim 17, wherein bleeding fluid pressure from the other steering pads comprises placing each of the other steering pads in fluid communication with the recess of the steering valve and the central channel of the valve seat.

19. A system for controlling steering pads of a rotary steerable drilling system comprises:

a valve seat comprising a central channel therethrough and a plurality of channels therethrough, wherein each of the plurality of channels corresponds to one of the steering pads, with fluid flow through the channels controlling activation of the steering pads; and a steering valve comprising a closed portion and an open portion, wherein the open portion comprises a cut-off-portion and at least one flow portion;

wherein:

the steering valve is disposed adjacent to the valve seat, with a first face of the steering valve adjacent to a second face of the valve seat, and is configured to rotate relative to the valve seat to control flow of fluid through the plurality of channels of the valve seat;

the steering valve comprises a recess disposed in the closed portion;

the steering valve comprises a blind notch recess extending radially in the cut-off portion, wherein the blind notch recess and the recess are not connected;

for each of the plurality of channels, the valve seat comprises a notch extending radially outward from the central channel, wherein each notch extends towards but does not intersect the corresponding channel; and responsive to the steering valve covering all of the plurality of channels, fluid pressure of one of the steering pads bleeds off through overlap of the blind notch recess and one of the notches in the valve seat to the central channel of the valve seat; and the fluid pressure of the remaining steering pads bleeds off through overlap of the corresponding channels with the recess in the steering valve.

20. The method of claim 19, wherein:

the blind notch recess comprises an inner end distance and an outer end distance, wherein the outer end distance is radially outward of the inner end distance;

the outer end distance extends radially outward sufficiently to allow for overlap with the plurality of channels in the valve seat when properly oriented;

each notch extends radially outward beyond the inner end distance;

each channel is positioned radially on the valve seat at a distance allowing overlap with the at least one flow portion of the steering valve; and the at least one flow portion of the steering valve comprises a first flow portion and a second flow portion, wherein the cut-off portion is disposed between the first flow portion and the second flow portion.

* * * * *